US012280907B2

(12) United States Patent
Phillips

(10) Patent No.: US 12,280,907 B2
(45) Date of Patent: Apr. 22, 2025

(54) AUTONOMOUS GIFT WRAPPING MACHINE

(71) Applicant: Roger Phillips, Jacksonville, FL (US)

(72) Inventor: Roger Phillips, Jacksonville, FL (US)

( * ) Notice: Subject to any disclaimer, the term of this patent is extended or adjusted under 35 U.S.C. 154(b) by 0 days.

(21) Appl. No.: 18/400,776

(22) Filed: Dec. 29, 2023

(65) Prior Publication Data

US 2024/0228902 A1 Jul. 11, 2024

Related U.S. Application Data

(63) Continuation of application No. 17/371,443, filed on Jul. 9, 2021, now Pat. No. 11,332,688.

(51) Int. Cl.

| | |
|---|---|
| ***B65B 11/04*** | (2006.01) |
| ***B65B 11/00*** | (2006.01) |
| ***B65B 41/12*** | (2006.01) |
| ***B65B 57/12*** | (2006.01) |
| ***B65B 61/02*** | (2006.01) |
| ***C10M 135/10*** | (2006.01) |
| ***C10M 169/00*** | (2006.01) |
| ***C10M 177/00*** | (2006.01) |

(52) U.S. Cl.

CPC ..... *B65B 57/12* (2013.01); *B65B 11/004* (2013.01); *B65B 41/12* (2013.01); *B65B 61/025* (2013.01); *C10M 135/10* (2013.01); *C10M 169/00* (2013.01); *C10M 177/00* (2013.01); *B65B 2210/04* (2013.01)

(58) Field of Classification Search

USPC ..... 53/461

See application file for complete search history.

(56) References Cited

U.S. PATENT DOCUMENTS

2023/0142034 A1* 5/2023 Engleman ..... B65B 49/08 53/531

* cited by examiner

*Primary Examiner* — Chinyere J Rushing-Tucker

(74) *Attorney, Agent, or Firm* — Vincent G. LoTempio; Brendan Lillis; Robert L. Cerasa

(57) ABSTRACT

An automation or robotics application to wrap objects that are cuboid-shaped and may have an arbitrary size. The machine includes a first module for advertising, dimensioning, and user interfacing. A second module is provided for wrapping paper handling. A third module provides a platform and object alignment assembly. A fourth module provides a gift wrapping chamber. A fifth module provides a taping and dispensing area. A sixth module provides a waste management area. The wrapping machine is configured to autonomously wrap the object and to deliver the fully wrapped object back to original position of the platform.

28 Claims, 14 Drawing Sheets

FIG. 9
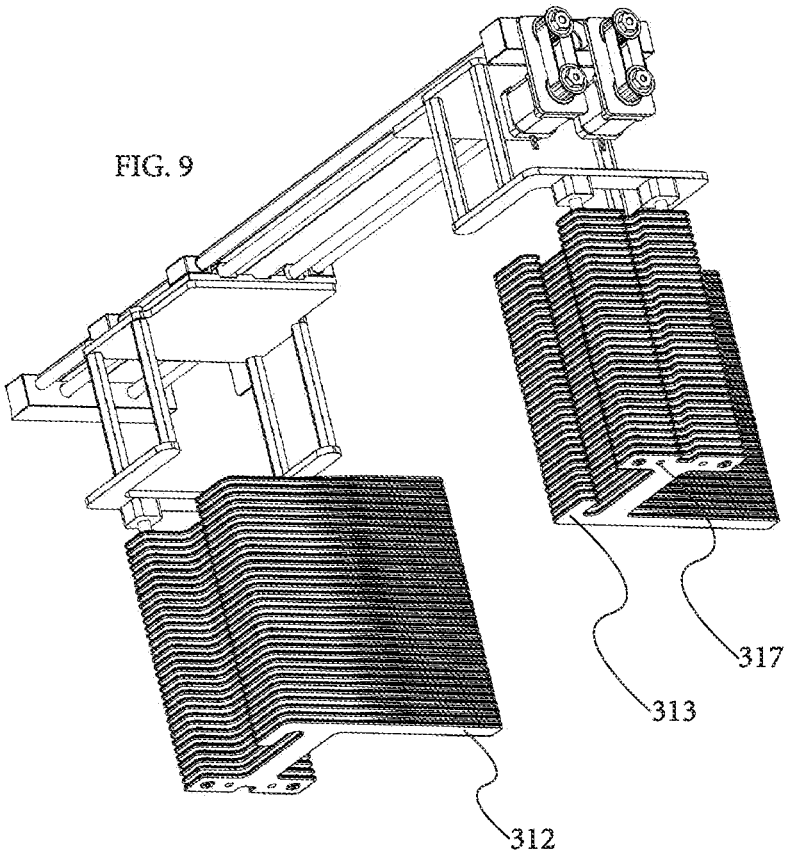
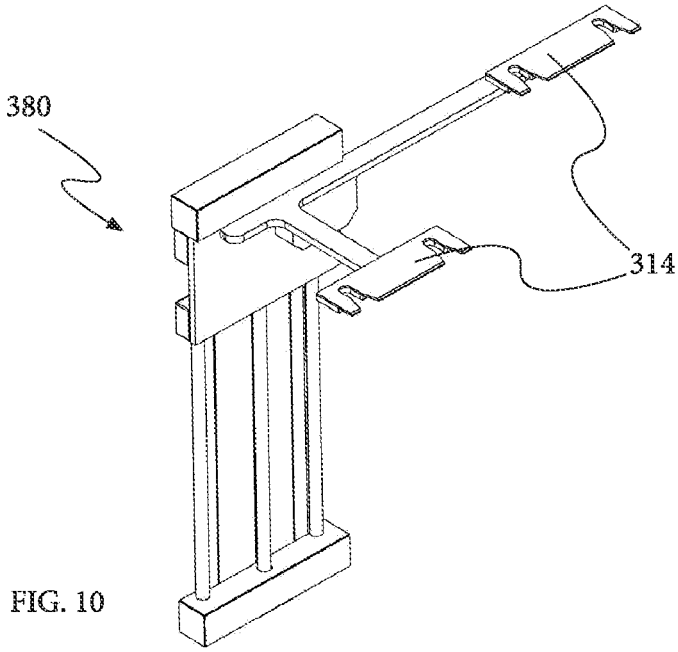
FIG. 10

AUTONOMOUS GIFT WRAPPING MACHINE

RELATED APPLICATIONS

The present application claims the benefit of the filing date of U.S. Non-Provisional patent application Ser. No. 17/671,443, filed Feb. 14, 2022, and U.S. Provisional Patent Application No. 63/148,889 filed Feb. 12, 2021, the disclosures of which are hereby incorporated by reference herein in their entirety.

TECHNICAL FIELD

This disclosure relates to a gift wrapping machine, and in particular to a machine that can automatically wrap cuboid-shaped objects of various sizes.

BACKGROUND ART

Gift-wrapping is a labor-intensive process, usually performed by hand, and one that requires skill and technique by a gift-wrapper in order to wrap a gift (or several gifts) neatly and efficiently. Boxes, such as those found in retail stores, department stores and online vendors, come in various sizes, and wrapping paper needs to be cut to a particular size to fit the box, if the end product is to be aesthetically pleasing. Folding, creasing and taping of the wrapping paper is also integral to achieving a quality wrap job.

Efforts have been made to create a machine in an attempt to automate the gift wrapping process. However, automating manual dexterity and the complicated nature of the gift wrapping process, particularly when taking into account boxes of various sizes, has proven a difficult engineering problem to overcome. For instance, U.S. Pat. No. 5,655,356 discloses an automatic package wrapping machine. Such prior designs have several limitations as they tend to be large in overall size, slow to work, and expensive to maintain, while likely to struggle with process steps such as adhesive application and with the efficient and automated wrapping of boxes having variable dimensions, particularly box height.

SUMMARY

The present disclosure has been made in view of the above-mentioned circumstances, and has an object to provide an automation or robotics application to wrap gifts that are cuboid-shaped and may have an arbitrary size. The cuboid shaped objects may be wrapped without any need for tilting or inverting the object whatsoever throughout the entire wrapping process. The machine includes a first module for advertising, box dimension and positioning calculations, and for providing a networked graphical user interface, which may further provide for authentication or targeted advertising to a user. A second module is provided for wrapping paper handling. A third module provides a platform with a box positioning assembly. A fourth module provides a gift wrapping chamber. A fifth module provides a taping and dispensing area. A sixth module provides a waste management area.

A preferred embodiment of the wrapping machine includes a user interface, at least one object platform, and at least one paper roll. A cuboid object may be placed on an object platform of the wrapping machine. The wrapping machine is configured to obtain dimensions of the object, and then the wrapping machine feeds, and cuts to size based on the dimensions, paper from the at least one paper roll. The wrapping may determine the position of the object on the platform. At least one wrapping machine component may be adjusted to accommodate a size of the object.

The wrapping machine then autonomously wraps the object within the paper. A fully wrapped object may then be delivered back to the platform on which it was originally placed, and the platform returned to its starting position. The object's position on the platform, its shape and dimensions as well as its identity may be ascertained using at least one camera.

The object platform may include a turntable. The paper may be wrapping paper. The wrapping machine may be configured to automatically align the object with the paper within the machine.

The dimensions of the object that are obtained may include the length, height, or width of the object. The measured dimensions may be used to determine a position of the object on the platform.

The wrapping machine may include a dimension selection assembly, wherein a particular size of the dimension selection assembly can be selected based on at least one measured dimension of the object. The dimension selection assembly may further comprise a shim selection assembly, and wherein a particular number of shims may be selected based on a measured dimension of the object, for example, based on the measured length, height or width of the object.

The wrapping machine can be further configured to fold flaps on at least one side of the object, using a selected size of the dimension selection assembly, for example a selected number of shim, wherein the selected portion is used to apply a shearing force adjacent the paper and across one or more sides of the object.

The wrapping machine is able to automatically manipulate and align the object within the machine for, and adjust at least one internal machine component based on a size of the object.

The wrapping machine is configured to wrap paper around four sides of the cuboid object, and to then fold flaps on the two open sides of the object using a selected size of the dimension selection assembly.

The flaps are folded and secured around the object automatically by the machine maneuvering the box and/or internal machine components within the machine. The flaps may be secured around the object using adhesive, such as tape or glue. Two opposing flaps may be secured across one side of the object without the adhesive coming into contact with the object. For example, a first flap may be folded against a side of the object, then adhesive placed on a portion of the folded first flap that will overlap with a portion of the opposing flap, and then the opposing flap may be folded across the object and secured to the first flap using the adhesive.

Thus, the wrapping machine has autonomously and fully wrapped the object.

In one embodiment, the wrapping machine includes a waste management module. The waste management module may further include a paper shredder, and the wrapping machine may be configured to process any excess cut paper, for example by shredding it, and store the processed paper in the waste management area, such as for recycling or repurposing. For example, the wrapping machine may further process excess paper into confetti or filler strips.

The wrapping machine may be configured to accept an object on an object platform, wrap the object within the machine, and then provide a fully wrapped object to a dispensing area, including back to a starting position of the object platform.

The wrapping machine may be configured to identify the object, such as using a barcode scanner and referential database, or a camera with image analysis, artificial intelligence processing, or the like. The wrapping machine may then select information from a memory or via a network based on the identification of the object, and also display the selected information via the user interface. In one embodiment, the selected information may be targeted advertising or messaging.

In some embodiments, the wrapping machine is configured to accept a selection of one of at least two different wrapping papers from the user interface. The user interface could be provided on a panel on the wrapping machine, or via a computer or mobile application. The machine may be connected to a network for transmitting information including machine diagnostic data, parametric data, information selected based on the identification of the object, and for providing the user interface. The wrapping machine may be further configured to obtain user authentication or payment information via the local or networked user interface.

Diagnostic data may be used to trigger and transmit an automated servicing or repair alert, such as a low paper alert, a low adhesive alert, a threshold-waste alert, or a machine error alert. Machine data, including machine diagnostic data, may be used to generate time schedules for machine servicing.

The wrapping machine may comprise any number of ancillary components, such as a label maker, a label printer, and a vending assembly configured to dispense gift wrapping accessories.

The wrapping machine may include a controller configured to connect and integrate with GPS or LiDAR systems for autonomous navigation purposes.

The wrapping machine may be integrated into a warehouse fulfillment or conveyance system, such as within an assembly line and integrated with a conveyor belt system. The wrapping machine may be configured to integrate with a point-of-sale system, such as within a retail setting.

Further provided herein is a method of wrapping a cuboid object. The object may be placed on a platform of a wrapping machine, the wrapping machine including a user interface and at least one paper roll. The wrapping machine may obtain dimensions of the object, and then feed, and cut to size based on the dimensions, paper from a paper roll, and wherein the wrapping machine proceed to wrap the object within the paper.

The wrapping process takes places autonomously within the wrapping machine, whereby the wrapping machine accepts an unwrapped cuboid object on a platform, fully wraps and secures paper around all sides of the object, and provides the fully wrapped object to a dispensing area, which may be back to the original location of the platform.

The embodiments disclosed in this application to achieve the above-mentioned object has various aspects, and the representative aspects are outlined as follows. With parenthetical reference to the corresponding parts, portions or surfaces of the disclosed embodiment, merely for the purposes of illustration and not by way of limitation, the present disclosure provides a machine that can automatically wrap cuboid-shaped objects of various sizes.

According to the above noted aspects, the disclosure entirely changes the retail and warehouse gift-wrapping landscape by automating the entire process. It allows for a speedy and fully-automated solution to a customer for wrapping gifts, and creates an entirely new standard for the gift wrapping paper and services industry. By integrating networking functionality, the disclosure also enhances operational efficiency for retailers in managing their inventory earmarked for gift-wrapping. The disclosure further provides a platform for retailers for digital out-of-home (DOOH) advertising that could be managed at the corporate or individual store level.

BRIEF DESCRIPTION OF THE DRAWINGS

FIG. 9 shows an isolated and perspective view of the other shim assembly according to one embodiment of the disclosure.

FIG. 10 shows an isolated and perspective view of one of the shim selector assemblies according to one embodiment of the disclosure.

DESCRIPTION OF THE PREFERRED EMBODIMENTS

Figure 1:
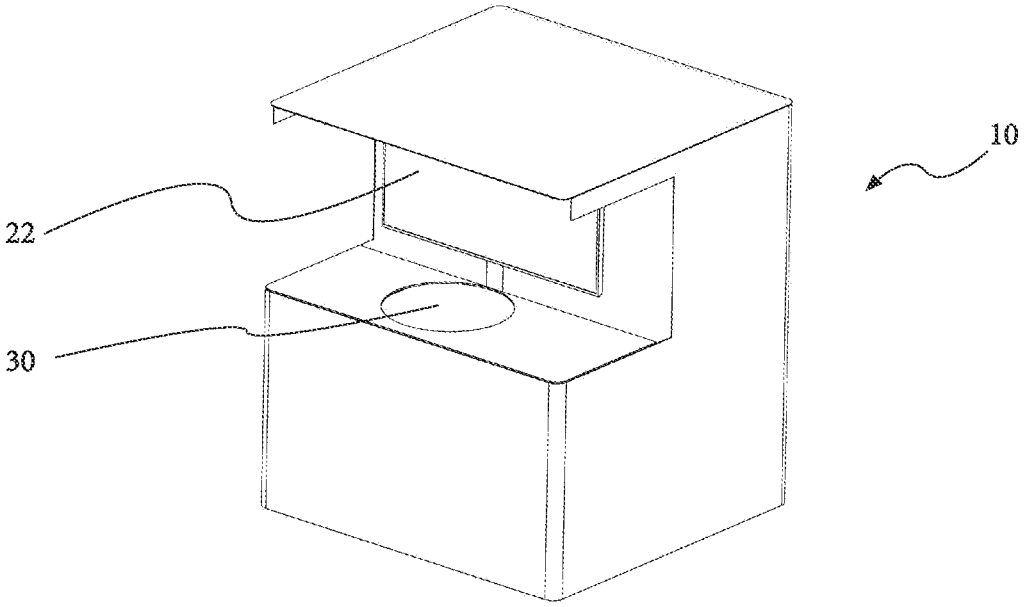
FIG. 1 illustrates a perspective view of one embodiment of the autonomous gift wrapping machine.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read together with the specification, and are to be considered a portion of the entire written description of this invention.

The disclosure is directed to an automation or robotics application comprising a machine configured to fully and autonomously wrap cuboid objects, wherein the machine sub-assemblies are capable of automatically pre-configuring themselves to accommodate cuboid objects having an arbitrary size within a pre-defined allowable range of minimum and maximum dimensions. There are no known autonomous machines available that are able to do so. The wrapping machine of the instant disclosure may be integrated within a commercial warehouse, or retail facility. The wrapping machine may further be connected with a network such that various scheduling tasks or inventory management can be efficiently performed or managed.

A preferred embodiment of the wrapping machine utilizes electro-mechanical automation to move internal mechanical components and to align or otherwise manipulate a cuboid object within the machine, without any need for tilting or inverting the object whatsoever throughout the entire wrapping process. The machine may be configured with a plurality of task-specific sub-assemblies. The machine may include mechanical components such as screws, linear rails, rotary cutters, mechanical adhesive applicators, sheet metal, metal rods and mounts, and the like components. A preferred embodiment also utilizes plastic and rubber material in various parts of the machine.

This disclosure includes support for a wrapping machine that incorporates ancillary components that are not strictly related to the primary wrapping function, including third party components, which components may include a camera (including a 3D camera and/or object dimensioning camera), a user interface for obtaining user selections and for broadcasting targeted advertising or other messaging, a display panel, a waste area with a paper shredder, a label maker, a label printer, a vending or dispensing area for wrapping accessories (such as bows or ribbons), and the like. The present disclosure utilizes microcontrollers that are programmed to perform automation tasks, as well as to connect the wrapping machine to a network.

In one embodiment, the wrapping machine disclosed herein is envisioned to be a first of its kind, fully-automated, on-demand, gift-wrapping machine, with an advertising display unit catering to a captive audience during the gift-wrapping process. The machine may provide a self-service kiosk-based solution at various strategic locations such as indoor malls, retailers and retail warehouses.

The wrapping machine may also be provided within or attached to a vehicle. In some embodiments, the machine may be integrated with the vehicle and a GPS or LiDAR system and configured for autonomous driving purposes.

The machine incorporates industrial automation while providing options for retailer-focused enhancements, such as including on or more digital displays, which may be configured to provide digital out-of-home advertising, and including integration with Internet-of-Things (IoT) technologies.

Machine dimensions of one embodiment may be approximately 54" wide, 55" deep, and 36" high. For a wrapping machine of approximately this size, a maximum cuboid object size that it may be configured to accept may be approximately 18"×12"×9", and a minimum size may be approximately 1"×1"×3". The size of the components and sub-assemblies of the disclosed machine may be modified to accommodate alternative ranges of acceptable object sizes.

Figure 2:
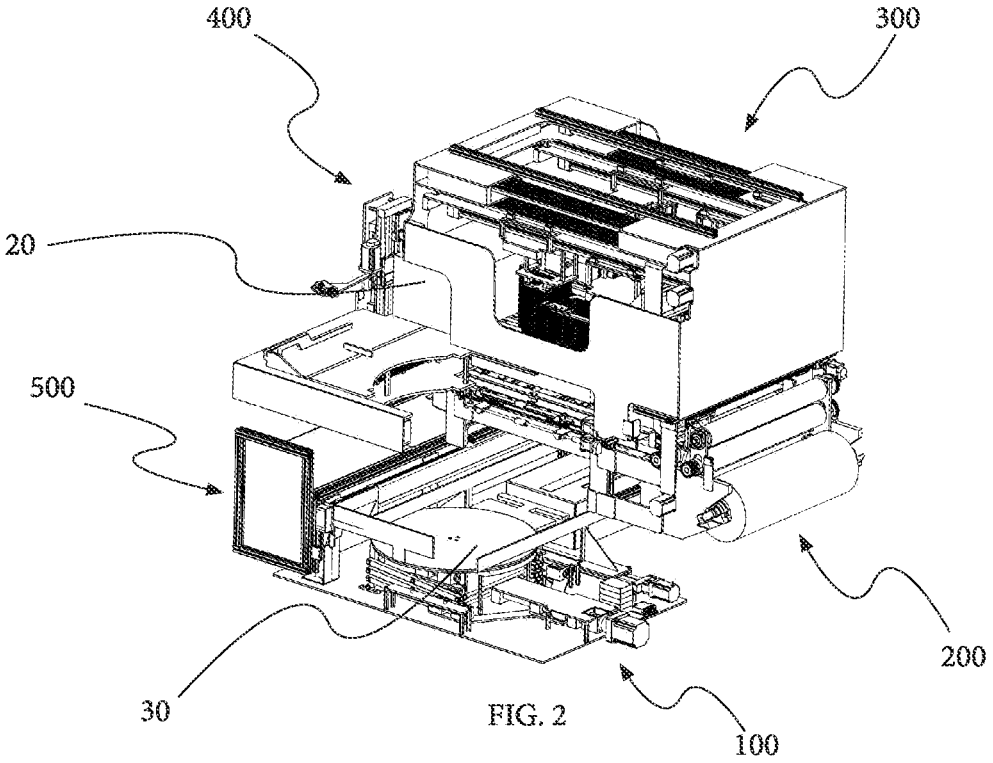
FIG. 2 shows the autonomous gift wrapping machine of FIG. 1, with its external frame and panels removed, revealing the interior of the machine.

Turning now to the drawings, FIG. 1 generally illustrates a preferred embodiment of wrapping machine 10 having at least one object platform 30. A user of wrapping machine 10 may be presented with a kiosk-type machine having a user interface, which includes a user interface 22, such as a screen, illustrated here as a touch screen by way of example. User interface 22 may alternatively be provided as another machine component separate from a screen, and/or provided via a computer or mobile application, such as via a smartphone application provided over a network. As shown in FIG. 2, when provided on the machine 10 as integrated with a screen, the user interface section 22 may be positioned at or around the eye level of a user of the machine.

In this embodiment, user interface 22 also incorporates an embedded object dimensioning and positioning camera system. This camera system is used to obtain images of a cuboid object that is placed onto platform 30, which can then be processed by software integrated on or with the machine 10. Similar to the user interface 22, the camera does not have to be integrated with a screen, and could e.g. be integrated with the wrapping machine 10 as a standalone component. The camera images may be processed for obtaining dimensions of the cuboid object, such as a gift, to be wrapped. These dimensions may include the length, width, and height of the object.

A generally cuboid object, such as a cardboard box, may be placed onto platform 30, to be wrapped within machine 10. A sensor, such as camera integrated within user interface 22, may be configured to obtain images of the object, which are then locally processed by the machine 10 controllers to determine the dimensions of the object. If the object is determined to be outside of a predefined min/max size range, or if the object is not generally cuboid in shape, this may be automatically detected and then the object may be rejected for wrapping, such as by sending a prompt via the user interface 22. Platform 30 may be configured with a scale, and wrapping machine 10 may be configured to obtain a weight of the object to be wrapped, and a similar acceptance or rejection with messaging could be prompted depending upon the object's weight.

Object dimensions may alternatively or additionally be obtained through reference to an object database containing such dimensions. For example, machine 10 may include a barcode scanner, which may be integrated within wrapping machine 10, such as within user interface 22 or as a separate component placed adjacent the starting position, or pathway, of platform 30. Scanning a barcode of an object, either manually or automatically, may cause machine 10 to retrieve the dimensions (and other information), locally or via a network, about the object to be wrapped.

If an object is accepted for wrapping (for example, based on an acceptable size determination and an approximately-cuboid-shape determination), machine 10 may begin wrapping the object immediately, or, e.g., depending on how the wrapping machine 10 is deployed, further steps may be required before the machine 10 proceeds to wrap the object. A user may be prompted to make a payment prior to proceeding further. For example, wrapping machine 10 may include a credit card terminal, or a payment interface may be provided via the user interface 22. User interface 22 may be further configured to confirm user authentication before an object is permitted to be wrapped.

After a determination of acceptable preconditions, wrapping machine 10 may be configured to proceed with wrapping the cuboid object that is placed on platform 30. In the illustrated embodiment, once machine 10 is triggered to begin wrapping, the object will automatically enter inside machine 10, go through processing within the machine 10, and then emerge back on platform 30, where it was originally placed, in a fully wrapped state.

Platform 30 may be configured to begin the wrapping process by lowering the object down into the automatic wrapping machine 10. In this case, an exposed hole on machine 10, where the object entered into the machine 10, may be closed off using an automated cover that is configured to close after the object has cleared the opening.

Figure 3:
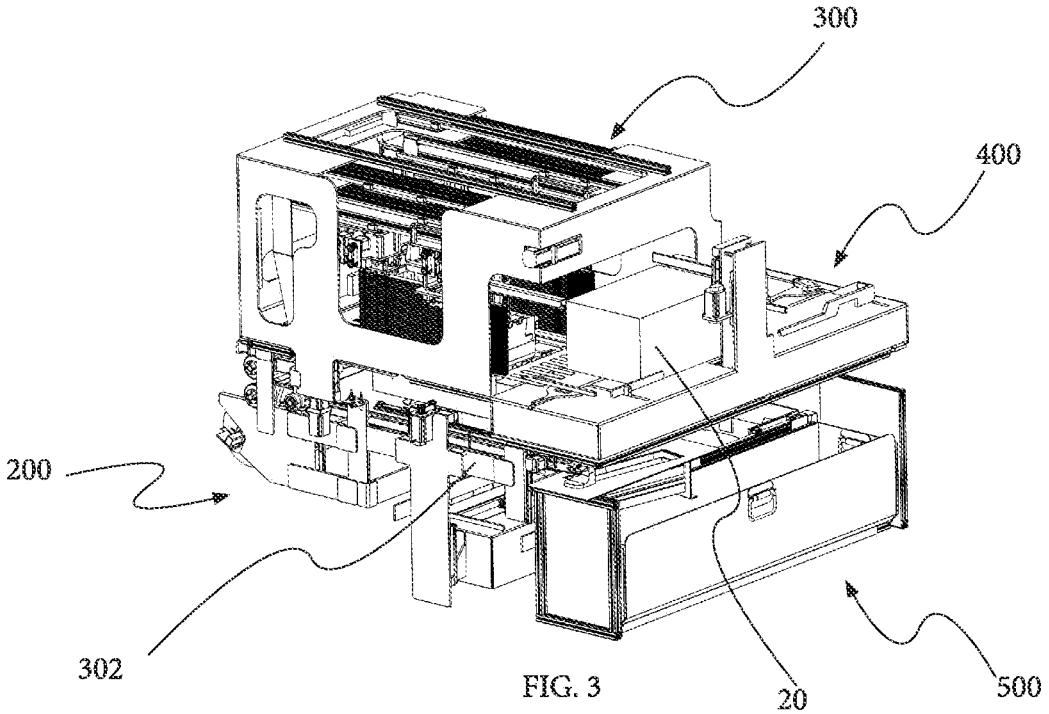
FIG. 3 shows an alternative perspective view of the autonomous gift wrapping machine of FIG. 2.

Turning to FIGS. 2 and 3, wrapping machine 10 of FIG. 1 is shown with side panels and outer frames removed, so that the several internal modules and sub-assemblies of machine 10 can be seen. Machine 10 may be configured with removable panels, or with access doors, to permit the servicing or maintenance of the interior components of machine 10. For example, machine 10 may include an access door adjacent to the paper handling module (described below), to permit efficient replacement of paper rolls. An exemplary cuboid object 20 is also shown within the machine 10 in FIGS. 2 and 3.

Figure 19:
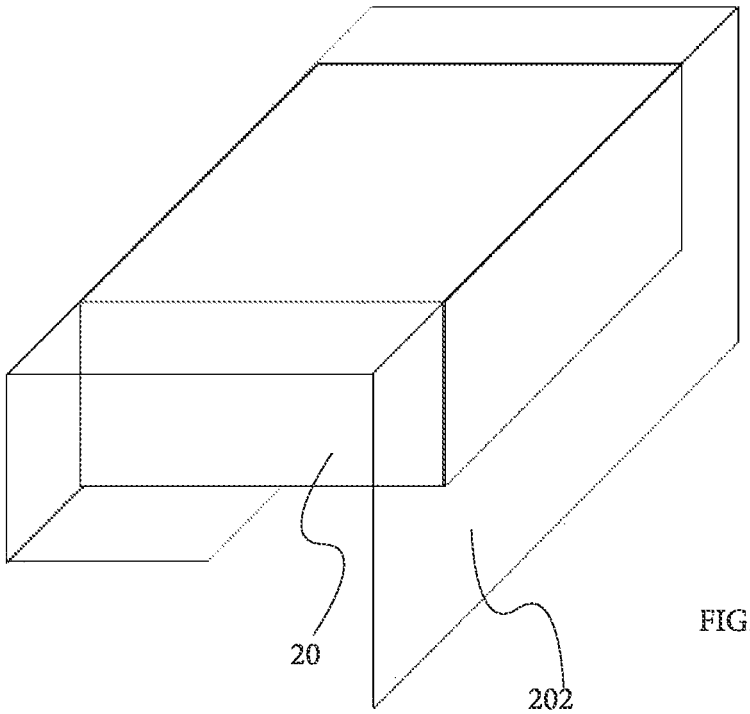
Figure 20:
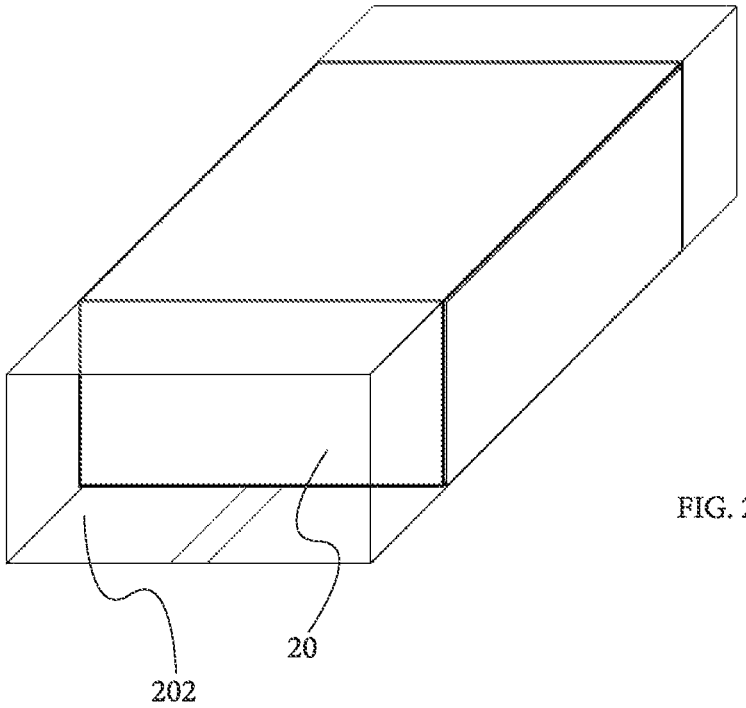
Figure 21:
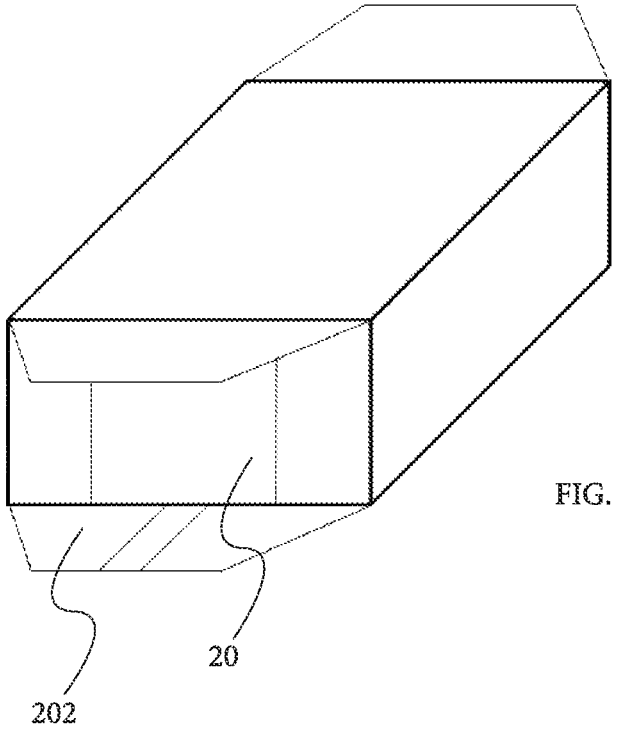
Figure 22:
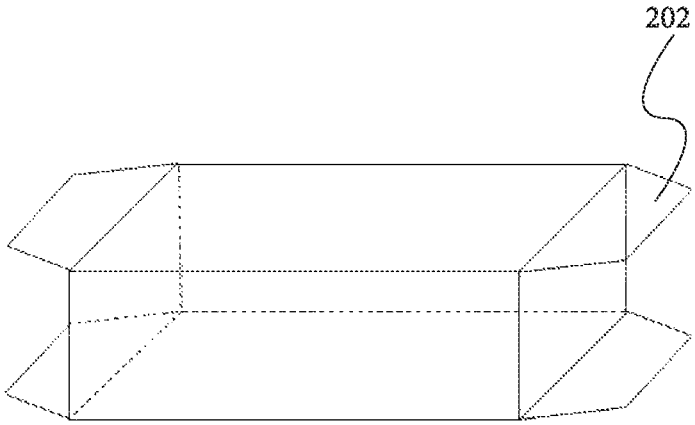
Figure 23:
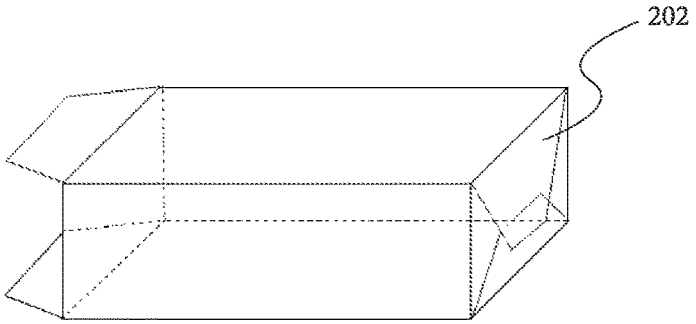

As will be described in further detail below, wrapping machine 10 broadly includes a number of task-specific sub-assemblies, including a platform module 100, a paper handling module 200, a primary wrapping module 300, an adhesive module 400, and a waste module 500. At a high level, the automated path that an object will take through the illustrated embodiment of machine 10 starts with machine 10 aligning the object on the platform 30 within the platform module 100. This alignment process may take place as the object is being lowered down into machine 10, and/or after the platform 30 has reached a bottom position within machine 10, as shown in FIG. 2. After alignment, the object is pushed to an area adjacent paper handling module 200, to a position below an opening where a cut-to-size piece of paper is ready and waiting. The object is then moved up to the primary wrapping module 300, being pushed through an adjustable wall assembly 302. The object has now been engaged with the pre-cut paper, which becomes partially wrapped around the top and two sides of the object via the object-and-paper engagement with the adjustable walls (as shown in FIG. 19). Machine 10 is configured to then wrap the paper around the exposed bottom side of the object (illustrated in FIGS. 19-20), followed by creating opposing flaps (or wings) adjacent the now-open sides of the object (as shown in FIGS. 21-22). The object is then moved to adhesive module 400, where machine 10 is configured to fold and secure the open flaps of paper around the object (as shown in FIG. 23). After such process, the machine 10 moves the object back to platform 30, which is then returned to its starting position where the object was initially placed on the platform.

Many of the movements within a preferred embodiment of the wrapping machine 10 are preferably performed unitizing a combination of mechanical arms, tracks, guides, rods, and motors (without any belts). In a preferred embodiment, the amount of time it takes from the initial lowering of an unwrapped object into the machine 10, to a fully wrapped object bring presented back at its starting location, is 30 seconds or less.

In one embodiment, paper, for example at least one roll of single or double sided wrapping paper, is positioned and cut to size at the same time while platform 30 is being lowered into machine 10 and while the object is aligned on the platform 30. The paper may be automatically cut to an appropriate size according to dimensions that are obtained from the object, for example length, width and height dimensions obtained via image analysis of the object on the platform using a dimensioning camera.

Figure 4:
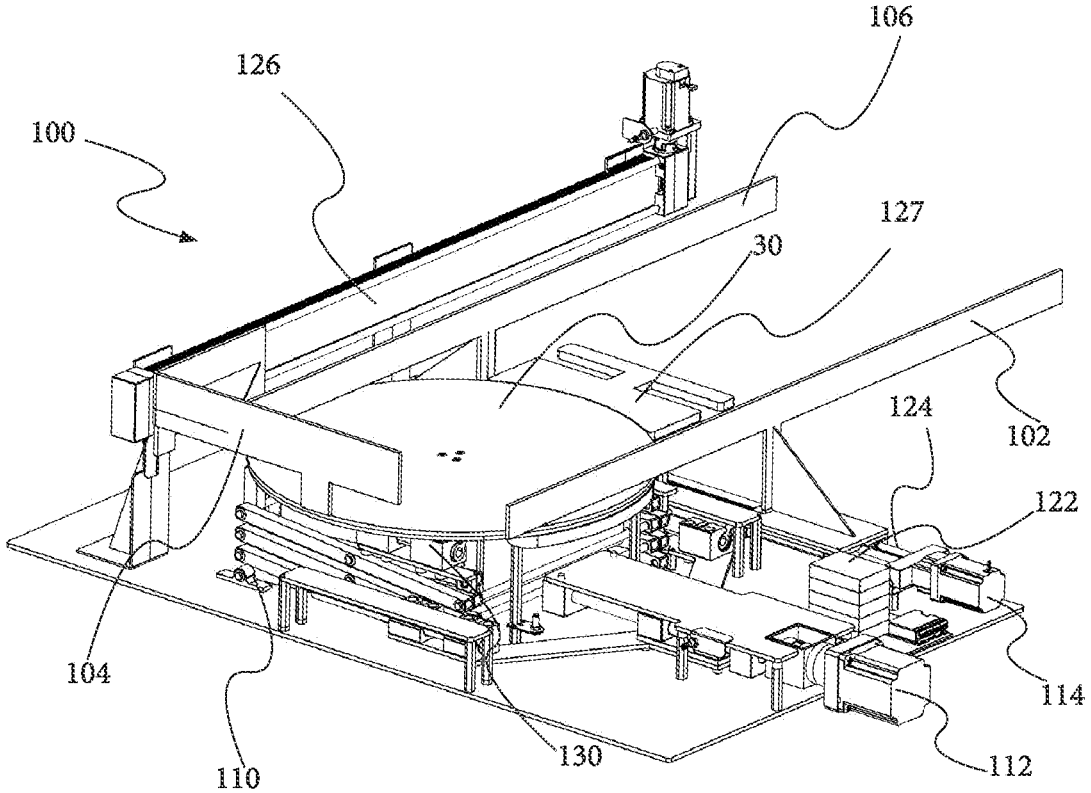
FIG. 4 shows a platform module according to one embodiment of the disclosure.

Turning to FIG. 4, the platform module 100 and associated object pathway through machine 10 is described in further detail. After an object is accepted for wrapping, platform 30 may be lowered into machine 10 to a bottom position. Platform 30 may be guided up and down by actuating a scissor lift 110, powered by one or more motors (e.g. motor 112 or motor 114), and controlled by a machine controller (for example, provided on a microcontroller mounted to a printed circuit board 122).

The object to be wrapped may be aligned onto a specific area of wrapping platform 30 using a combination of guide arms 102, 104, 106, as well as any corresponding rails, guides, screws, motors and/or sensors. For example, FIG. 4 shows that arm 102 is movable back and forth along track assembly 124, and arm 104 is movable along track assembly 126. Each arm 102, 104, 106 is sized and positioned in such a way as to be capable of aligning the object on the platform and pushing the aligned object off the platform, for instance by using arm 104 to push the object in a direction across shelf 127 and onto the surface of a baseplate 120 (shown in FIG. 5). The arms are configured and arranged such that they do not interfere with each other.

Additionally, FIG. 4 illustrates platform 30 mounted to a turntable assembly 130. In this instance, the turntable assembly 130 can additionally or alternatively be used to align the object placed on platform 30.

The automated object alignment process ensures that the object is properly squared at a desired angle before proceeding further on into machine 10. For instance, if the object to be wrapped is a cuboid box, arm 102 may be used to push the box along platform 30 towards arm 106, such that two sides of the box are aligned parallel to arms 102 and 106. In this case, a third side of the box will now be parallel to arm 104 as well, and in position to be pushed by arm 104 towards shelf 127.

Machine 10 may include a plurality of framing elements (such as those shown in FIGS. 2 and 3), which may be used to separate the machine subassemblies from each other, and which may also be used to mount various machine components.

Figure 5:
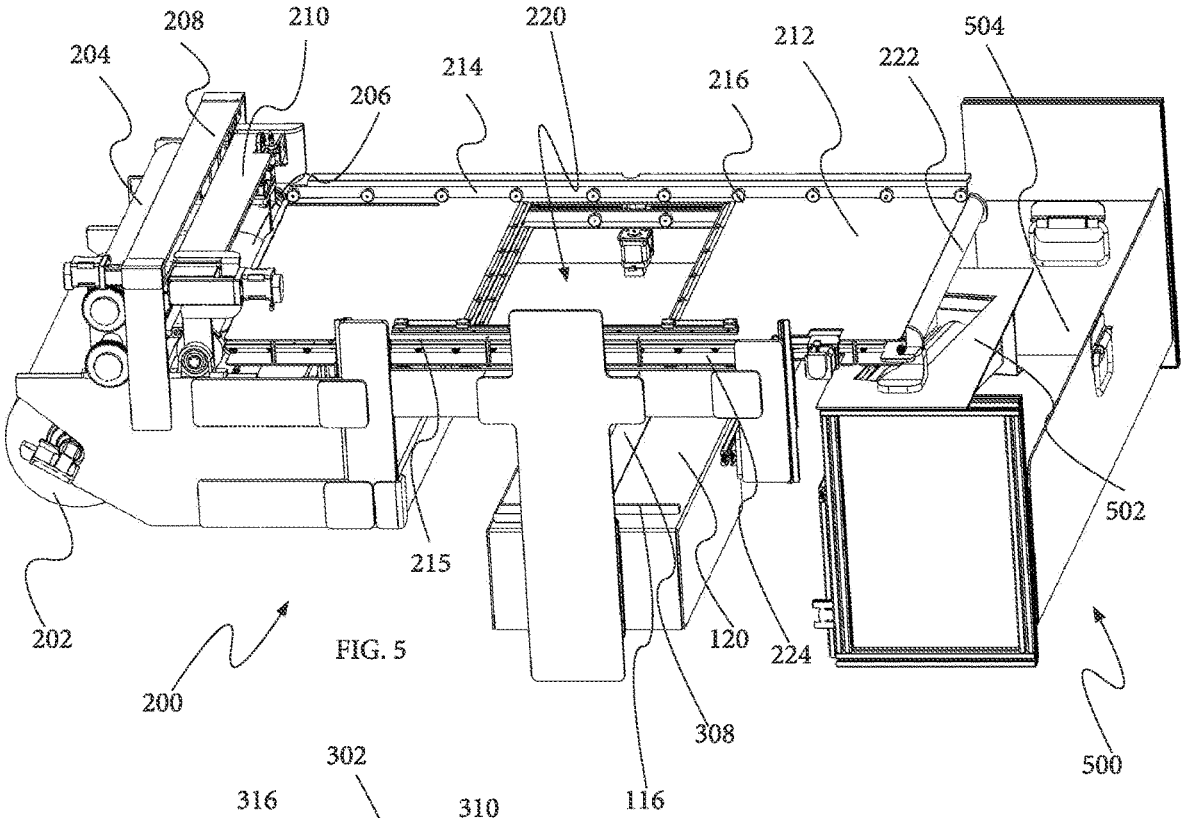
FIG. 5 shows a paper handling module according to one embodiment of the disclosure.

After an object is aligned on platform 30 using arms 102, 106 and/or turntable assembly 130, arm 104 may be triggered to move the object towards the lower rear portion of the machine. With reference to FIGS. 4 and 5, arm 104 may push the object across shelf 127 and onto baseplate 120. Baseplate 120 may include stopping arm 116, so that when arm 104 guides the object from platform 30 to baseplate 120, the box may now be maintained in an aligned position on baseplate 120. Arm 104 may be triggered to stop pushing the object onto baseplate 120 based on a sensed resistance to further pushing caused by the engagement of the object with stopping arm 116.

At any time during or after the above-described box alignment and pushing processes, one or more distance sensors may be configured to measure the precise spacing between arms 102 and 106, and between arms 104 and 116. These measurements may be used to obtain certain dimensions of the cuboid object (e.g. corresponding to a length and width of the object to be wrapped) after the object has been aligned, as described herein. These measurements may be additional to, or in lieu of, any measurements obtained earlier as described above. In one embodiment, a camera and image processing system may be used to obtain (relatively) approximate dimensions of the object to be wrapped, while the platform assembly distance sensors may be used to confirm the dimension obtained by the image processing, or such sensors may be used to obtain more accurate dimensions, which can then be sent to other machine components. For example, a controller of machine 10 may be configured to take some preliminary action(s) based on the initial dimensioning data (for instance, by rolling out an approximate amount of paper needed to fully wrap the object), and then a controller of machine 10 may be further configured to cause a follow on action to take place based on the new information (for example, the amount of that is paper rolled out might be finely adjusted, and/or confirmed for cutting).

Referring now to FIG. 5, shown is an embodiment of an isolated paper handling module 200. Paper handling module 200 is preferably configured to hold at least one full ream of industry standard size wrapping paper 202, approximately 834'. The machine 10 may contain one or more tension rollers, rubber rollers or other rollers (see, e.g. nip assembly 204 and anvil roller 206), which can be used to feed paper 202 through the paper cutting area and onto paper platform 212. The paper handling module 200 may be expanded to hold additional wrapping paper reams for more paper choices.

Paper handling module 200 preferably includes two paper cutting mechanisms, x-axis cutter assembly 208 (for cutting parallel to the paper roll) and y-axis cutter assembly 210 (for cutting perpendicular to the paper roll). The wrapping paper cutters that are used may be those as generally used in the industry for cutting paper. In a preferred embodiment, as soon as machine 10 has obtained the necessary object dimensions for the y-axis of the object to be wrapped (e.g. the distance between guide arms 104 and 116 as described above, and adjusted according to a sizing formula, as described in greater detail below), the blade of y-axis cutter assembly 208 is moved into a desired position, and a proper amount of paper 202 (sized to wrap the object) is fed through nip assembly 204. As the paper 202 is fed though nip assembly 204 and onto platform 212, the paper 202 engages with a blade positioned in y-axis cutter assembly 208 which cuts the paper 202 to proper width. After moving to a desired position according a needed dimension of the object, the y-axis cutter may remain stationary, and its blade is preferably sharp enough to cut paper 202 as it is being fed through nip assembly 204. The y-axis cutter could alternatively be energized to rotate and/or zip along the paper to be cut.

Once the desired amount of paper has been fed through (e.g. as determined using the dimensions between guide arms 102 and 106 and adjusting according to a sizing formula), then a blade within x-axis cutter assembly 210 may be triggered to zip across and cut paper 202 to length. The x-axis cutter may be a rotary cutter.

The sized and cut paper for wrapping an object is now positioned along platform 212 and centered above an opening 220 in the platform 212, while the excess paper, cut off from the usable paper by y-axis cutter 208 (if any), is sent to waste disposal module 500, which may include a paper shredder 502 and a storage basket 504.

After the y-axis cutter has finished its cut, tracks 214, 215, each having a plurality of mini rollers 216, are moved from an upper position slightly above platform 212 to a lower position adjacent platform 212 to engage the cut paper and to secure the cut paper onto platform 212. The mini rollers 216 may also be configured to take over movement of the cut paper from the paper roll or other roller motor(s). In this fashion, the paper is not actuated by two different motors at the same time, which reduces or eliminates risk of the paper 202 ripping as it is manipulated. As shown in FIG. 5, track 214 is configured to engage the measured and usable portion of cut paper 202 that will be used to wrap the object, while track 215 may engage the excess portion of the wrapping paper (if any) to be sent to the waste processing area. If there is no excess paper, e.g. if the entire width of paper 212 is needed to wrap an object, then track 215 will simply engage the edge of the usable paper opposite the side of the paper that is engaged by track 214.

If the object to be wrapped is relatively small in size (and/or the cut paper is small in size), there may be included an additional rail/support assembly that is moved over box opening 220 (which the paper has to glide over) to support the paper 202 such that the cut paper is maintained in a desired position over opening 220 and properly aligned with the object to be wrapped. For small boxes that are fed into a machine 10 that is also configured to also accept larger boxes, sometimes the cut paper 202 will not be supported over this open area 220 of platform 212 without further support, so an additional guide may be used to help push the object through the opening 220 adjacent the aligned and cut paper (as described in greater detail below).

Paper 202 may be two-sided, or paper 202 may be fed onto platform 212 such that it is desired to have the paper be flipped over so that the opposite side of the paper is facing outwards. In this instance, the paper 202 may be moved by tracks and rollers 214-216 across platform 212, into guide 222, and onto sub-platform 224. An additional track/roller system adjacent sub-platform 224 may be used to re-engage the flipped-over paper 202 and align it adjacent platform opening 220, where the process proceeds in the same fashion. Thus, an object may be autonomously wrapped using a selection of two-sided wrapping paper.

Now with reference to FIGS. 5-6, a process for moving the object to be wrapped from platform 120 into the primary wrapping chamber 300 will be described.

Figure 6:
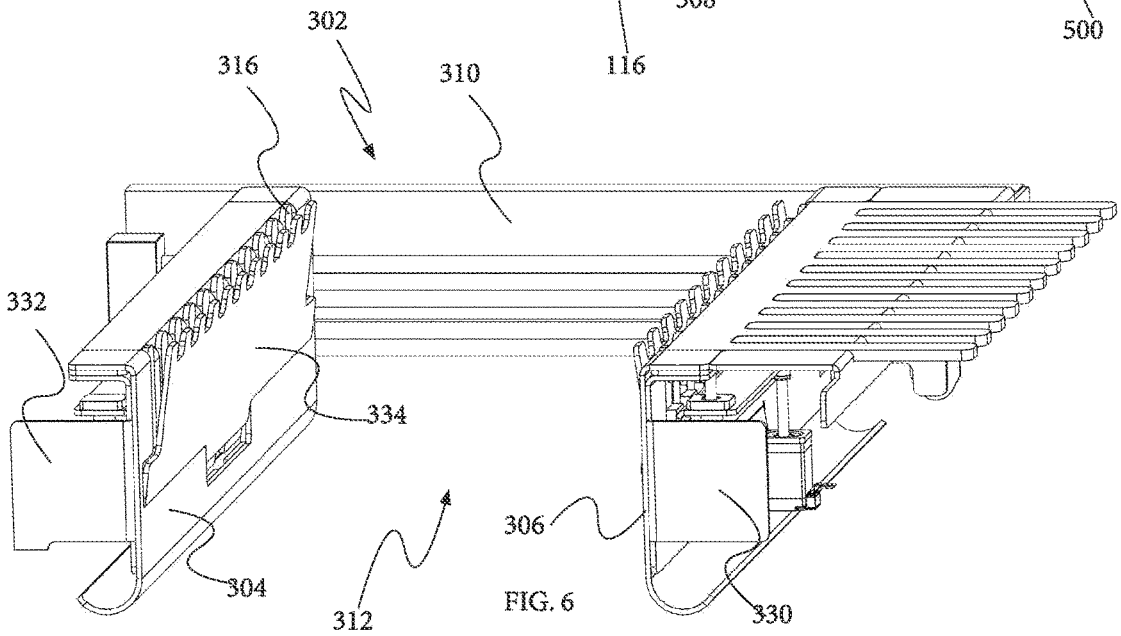
FIG. 6 shows an adjustable wall module according to one embodiment of the disclosure.
Figure 7:
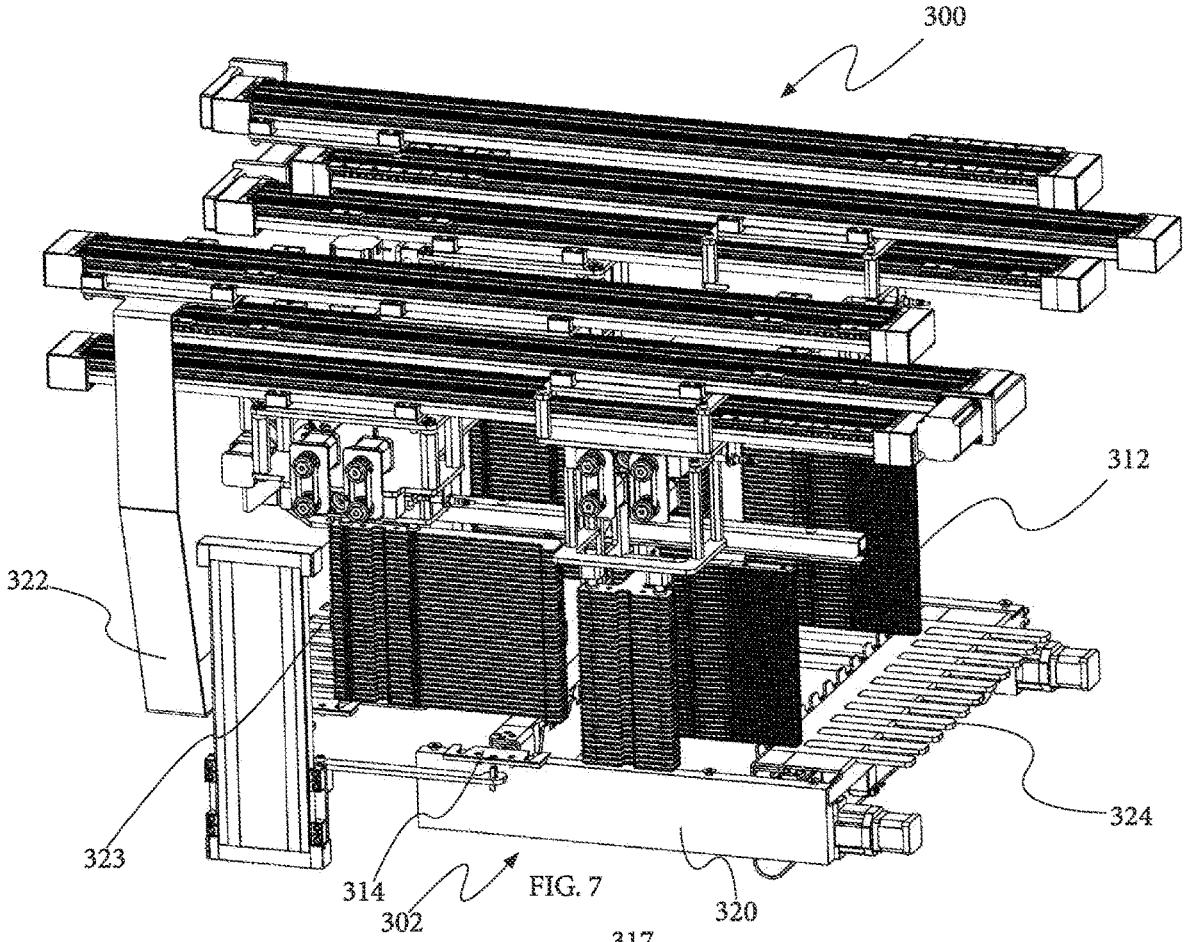
FIG. 7 shows a primary wrapping chamber according to one embodiment of the disclosure.
Figure 8:
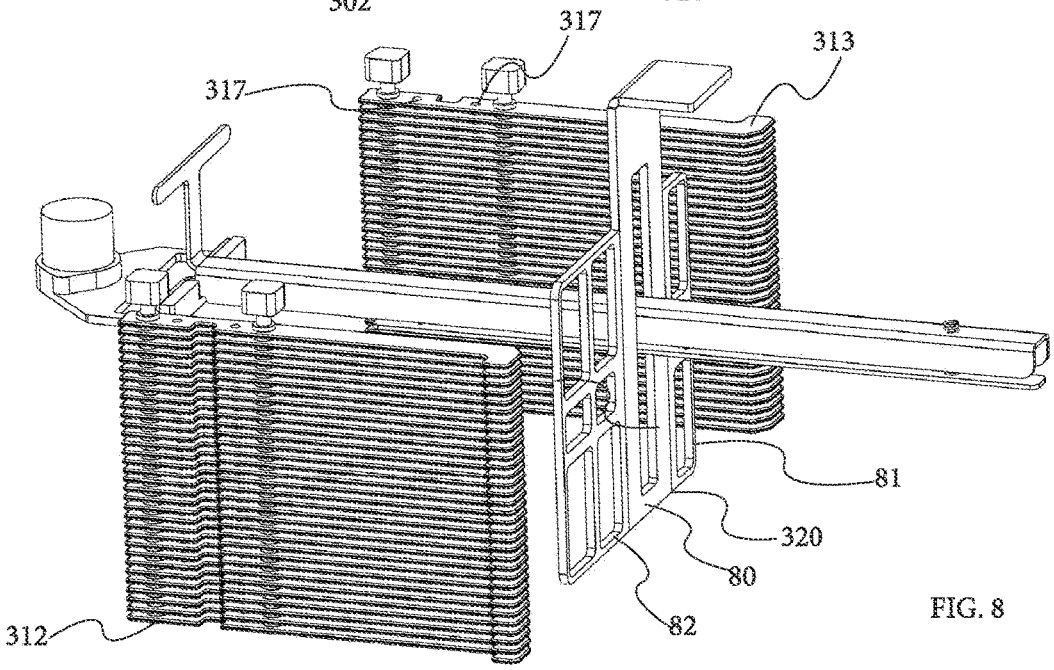
FIG. 8 shows an isolated and perspective view of one of the shim assemblies and adjustable pusher according to one embodiment of the disclosure.
Figure 11:
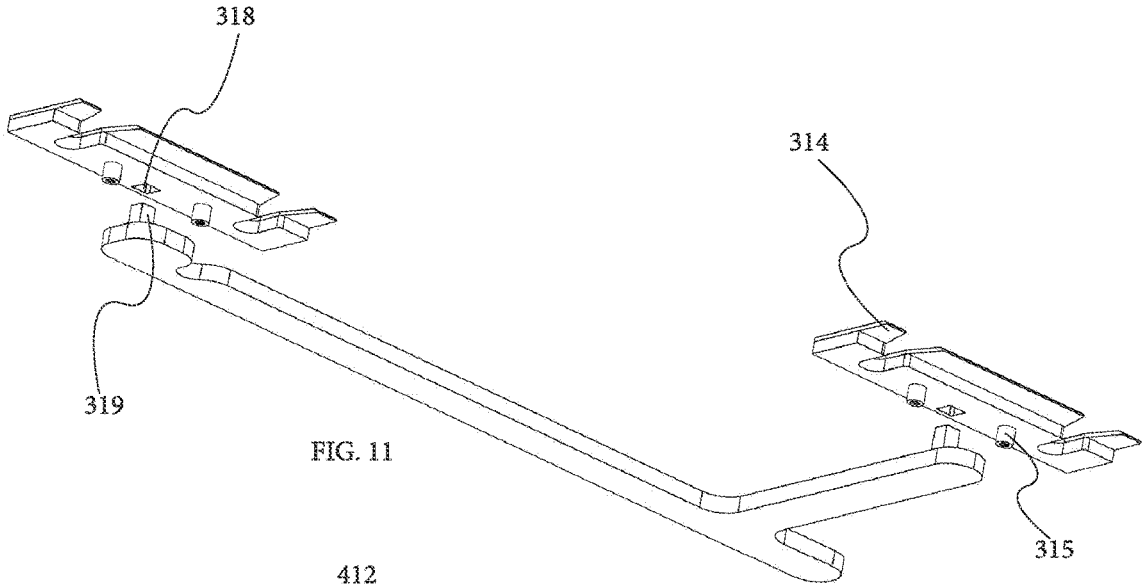
FIG. 11 illustrates an alternative isolated and perspective view of one of the shim selector assemblies according to one embodiment of the disclosure

A preferred embodiment of machine 10 may include an adjustable wall mechanism 302, as shown in isolated detail in FIG. 6. Moveable wall mechanism 302 may have two walls 304, 306, that are sized to coincide with a dimension (e.g. the width) of the object to be wrapped. A motor may be activated to move wall 306 along at least one track 310, thus creating an opening 312 that is sized according to the corresponding chosen dimension of the object to be wrapped. In other configurations of machine 10, both walls 304 and 306 may be moveable. Alternatively, each wall 304, 306 may be stationary, e.g. if machine 10 was configured to wrap a number of objects having a consistent size along at least one dimension. Although FIG. 6 shows adjustable wall mechanism 302 connected to a single track 310, a second track 320 (shown in FIG. 7), configured to mount on the opposing side of mechanism 302 to brackets 330, 332, may also be included.

As shown in FIGS. 5-6, baseplate 120 may include a riser 308 used for lifting the object to be wrapped off of the surface of baseplate 120, up through opening 220, and continuing through opening 312 that is created between walls 304, 306. Machine 10 may be configured such that riser 308 is triggered to release after the object is securely aligned on baseplate 120 (with one side of the object square to and adjacent arm 116), and after paper 202 is cut and positioned with the desired side facing outwards over opening 220 of platform 212 or sub-platform 224 (as applicable). At this stage of the wrapping process, the cut-to-size wrapping paper 202 is position directly over a top surface of the object to be wrapped. The riser 308 is now raised so that the box extends though opening 220, contacting paper 202, and continuing through opening 312, such that walls 304 and 306 are utilized to create a roughly U-shape of paper around the top of the object, as generally shown in FIG. 19.

Walls 304 and/or 306 may be spaced and configured to loosely engage the sides of the box while the box is being pushed through the openings 220, 312. Once the box is extended mostly (or completely) up into space 312 between walls 304, 306, then walls 304, 306 may be configured to close paper 202 more snugly around the sides of the box. Further, walls 304, 306 may each include a section configured to help fold the paper over the top of the object in a gradual and snug fashion. For instance, walls 304, 306 may each include a spring loaded sub-wall 334, 336, wherein opening 312 is configured to start out at a first size, and wherein the size is gradually and gently reduced as the object is advanced between the sub-walls 334, 336, until the springs of the sub-walls 334, 336 are engaged due to contact with the advancing object, at which point the paper that is surrounding the top side of the object is securely positioned around the top and two adjacent sides of the object in a general-U-shape.

In another embodiment, riser 308 may push the object most of the way, but not all of the way, up into space 312, and a smaller sub-riser (not shown) may be configured to release from riser 308 and push the object the rest of the way up. This sub-riser configuration and process may further coordinate with a temporary closing off of opening 312, as described herein.

Walls 304, 306 are further configured to include at least one retractable pin 316. A plurality of pins 316 are illustrated in FIG. 6 in a retracted position, whereby the height of each pin 316 is approximately flush with the height of the walls 304, 306. Pins 316 may also be extended upwards so that they sit at a level above the tops of walls 304, 306. Pins 316 will generally start out in a retracted position, and then be triggered to an extended position, for reasons noted in the below discussion of the primary wrapping chamber processes.

Now referring to FIGS. 7-11, the wrapping machine 10 components and wrapping process related to the primary wrapping chamber 300 will be described.

According to a preferred embodiment of the disclosure, primary wrapping chamber 300 includes a novel dimension selection system, such as a slat, shim, or wall size selection system, which is used to select a component or components of variable height, and which are used to wrap flaps or wings around a plurality of cuboid objects having variable sizes. In particular, the dimension selection system allows machine 10 to automatically wrap a plurality boxes having variable heights from box to box. Prior wrapping machine solutions may include a fixed-height component that is used to assist with wrapping the sides of a box. However, prior machines are not able to automatically handle the adjustment of the height of multiple objects to be wrapped, on the fly and without manual intervention.

In one embodiment of the present disclosure, the dimension selection system comprises a plurality of slats (or shims) 312, which are provided for securely wrapping paper to the sides of the object to create opposing flaps or wings. A plurality of slats 312 may be placed adjacent one another to create a stack of slats. Each slat 312 within a stack may be separated by one or more spacers. Machine 10 may include four such stacks of slats, corresponding to four areas of engagement on the paper. The precise number of slats 312 needed to wrap flaps on any particular object is automatically adjusted and selected for based on an actual measured (or otherwise obtained) dimension of each object to be wrapped. For example, once the height of a box is known, that tells the machine 10 how many slats 312 to select, which may be done using a controller connected to a slat selector system, as described in further detail below.

A machine controller may be configured to insert a wedge 314 between two particular shims 312 of a stack according to a dimension of the object to be wrapped. An actuator moves a selection assembly 380 having at least one wedge 314 to a desired position. The wedge 314 engages, in an area created by the slat spacers, a stack of slats, and the wedge 314 lifts up a desired subset of slats 312 within the stack (for example, based on measured box height). The wedge 314 can disengage from the selection assembly and engage with the shims 312 on either side of it and temporarily lock into place within the shim stack. Once a chosen number of shims 312 are selected, they can be moved along two axes (forward/back and side-to-side) for alignment with the paper 202, at this stage now surrounding the object on at least 3 sides. This shim selection process preferably occurs right after receipt of the necessary object dimensions, e.g. from a dimensioning camera or other object sensors that may be located within machine 10. The machine 10 may engage a wedge 314 with its corresponding stack of shims by moving the stack of shims and/or the wedge to their desired positions via mechanical tracks or rails, and shown in FIGS. 7-10. After a selected set of shims 312 are used to create corresponding flaps around an object, machine 10 may be configured to unlock the wedge 314 from each stack of slats, thus returning each wedge 314 to a corresponding selection assembly and resetting the dimension selection system to its original configuration.

As indicated above, a selected group of shims 312 may be used to create paper wrapping "wings" on each side of the object. Accordingly, a particular number of slats 312 may be selected based on the height of the object, minus a slight space at the bottom of the object and minus an equal space at the top of the object. The slats 312 are configured and may be moved and positioned to push over and across the sides of a partially-wrapped object using a shearing force, to create opposing flaps or wings on each side of the object. The slats 312 may alternatively be held in a specific and stationary position as an object is pushed adjacent the slats 312. The wedge 314 creates a space between two shims, such that, as the object is engaged against the stack of shims, a flap that is being created (e.g. at the top of the object) slides through the open space between the two shims on either side of the wedge.

In a preferred embodiment, each stack of slats is positioned and arranged such that a selected set of slats pinches the paper against the object at a slightly increasing rate as the object moves across the stack. That is, the leading edge of the shim stack maybe be positioned slightly away from the edge of the object that it engages, and wherein the trailing edge of the shim stack may be positioned closer to the edge of the object that it engages, such that the paper is folded around the sides of the object in an increasingly tightening/pinched manner. Thus, risk of ripping the paper is reduced, and a nice tight wrapping seam is created.

Slats 312 may be further configured such that each has a softened or sloping leading edge 313, such that the slats engage the paper without any sharp edges or corners, further reducing risk of ripping the paper as shearing forces are applied to create the flaps.

Wedges 314 may be configured with one or more pins 315 configured to mate with one or more corresponding slots 317 in each slat, to be used for temporarily secured each wedge 314 into place between at least two slats 312. Each wedge 314 may be similarly configured having a slot 318 configured to engage with a corresponding pin 319 positioned on an arm attached to the selection assembly 380. Thus, a wedge 314 can pass back and forth between the selection assembly 380 and a corresponding stack of slats 312.

Wrapping chamber 300 includes a moveable and adjustable wall panel (or pusher) 320 (shown in FIG. 8), which is used to brace and push against the object, as will be described below with respect to the wrapping process. Adjustable panel 320 may include a primary panel 80 and one or more secondary panels 81, 82. In a preferred embodiment, the primary panel of adjustable panel 320 may be approximately three inches in width (or otherwise corresponding to a minimum box width acceptable by machine 10). A first secondary panel 81 may be two inches in width, thus the primary panel plus first secondary panel may support boxes between approximately three inches and five inches in width. A second secondary panel 82 of adjustable panel 320 may be approximately five inches in width. Thus, adjustable panel 320 may be configured to support a box size of between approximately five and eight inches in width, or between approximately between eight and ten inches in width, depending on which of the adjustable panels are engaged. One of ordinary skill will appreciate that any appropriate sizes of panels can be used.

Figure 18:
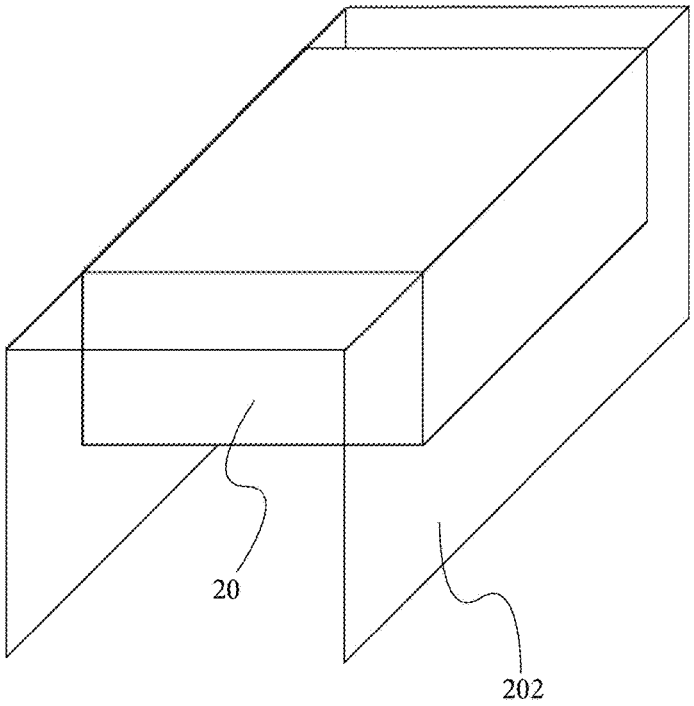
FIGS. 18-23 illustrate the approximate states of a box in the process of being wrapped, shown at various stages of the wrapping process.

Now the process of steps taking place within the primary wrapping chamber 300 will be further described. As indicated above, at this stage there is a box within chamber 300, extending through space 312 between walls 304 and 306, said box being covered with wrapping paper on its top and sides in a U-shaped configuration as generally shown in FIG. 18. Pins 316 begin in a retracted position, flush with the tops of walls 304, 306. Four stacks of slats 312, with proper heights having been selected as described above using four wedges 314, are positioned adjacent to the sides of the object in preparation for folding the paper over two of the open and unwrapped sides of the object. That is, two stacks of shims are positioned on each side of the "U" shape created by the paper. In one embodiment, the dimensions of the wrapping wings (i.e. the selected heights of each group of slats) is configured to be approximately equal to (0.6*side of object to be wrapped).

Next, pins 316 move into an extended position. This is done to hold the object in place in preparation for engagement with the stacks of slats, bottom folding arm 322, or other wrapping components. Bottom folding arm 322 is engaged to slide underneath the object, folding the paper along one half of the bottom of the box. Folding arm 322 may be configured with a plurality of teeth 323 positioned to fit in between the plurality of pins 316 in order to allow said teeth to engage and fold the paper around the bottom of the object while the plurality of pins 316 are still in their extended positions. Thus the object is held in place and machine 10 is able to wrap paper tightly and securely around a bottom side of the object, without ripping the paper. The approximate positioning of the paper around the object is now as shown in FIG. 19.

Next, two groups of slats 312 that are adjacent to side of the bottom folding arm 322 are moved adjacent the paper and across the object with a shearing force, engaging the paper against one half of each side of the object, thus creating the first half of what will become two opposing paper flaps or wings. Pins 316 are once again retracted to be flush with walls 304, 306, now allowing the object to be pushed around freely.

Then, wall panel 320 is used to push the box in a direction towards adhesive module 400, in between the other two groups of slats 312, and over bottom folding platform 324. As the object is pushed across bottom folding platform 324, the remaining half of the unwrapped portion of the paper on the bottom of the object is folded over, as generally illustrated in FIG. 20. The size of the paper may be such that the paper overlaps on the bottom of the object. Machine 10 can be configured to cut paper to size according to any desired amount of such overlap.

As the bottom side of the object is being wrapped, as the object is pushed across bottom folding platform 324, the object is simultaneously pushed adjacent the two remaining stacks of pre-positioned slats. These stacks may be held stationary while the object is pushed across/through them. As the object is pushed through the space between these stationary groups of slats, the slats engage the paper and fold it over the remaining exposed side of the object, thus finishing creation of the opposing paper wings. The state of the object is now as generally shown in FIGS. 21-22.

The partially wrapped object having four wings (two opposing wings on each side, one on top and one on bottom of each side) is now pushed by panel 320 on a new plate or platform in the machine 10 within adhesive module 400. Now, the machine 10 is configured to close and seal the top and bottom flaps on each side of the object, before the object is pushed back onto platform 30 for delivery back to the platform 30 starting position.

Within adhesive module 400, panel 320 pushes and secures the object against railing 402, and the machine 10 is then configured to advance the partially wrapped object towards the adhesive application mechanism, without disturbing the unsealed wings (which are now aligned perpendicular to railing 402). The object now must be aligned to a specific location within module 400, which will permit additional mechanical flap closing arms to properly engage. In one embodiment, flaps may engage the object as far as 13".

Figure 12:
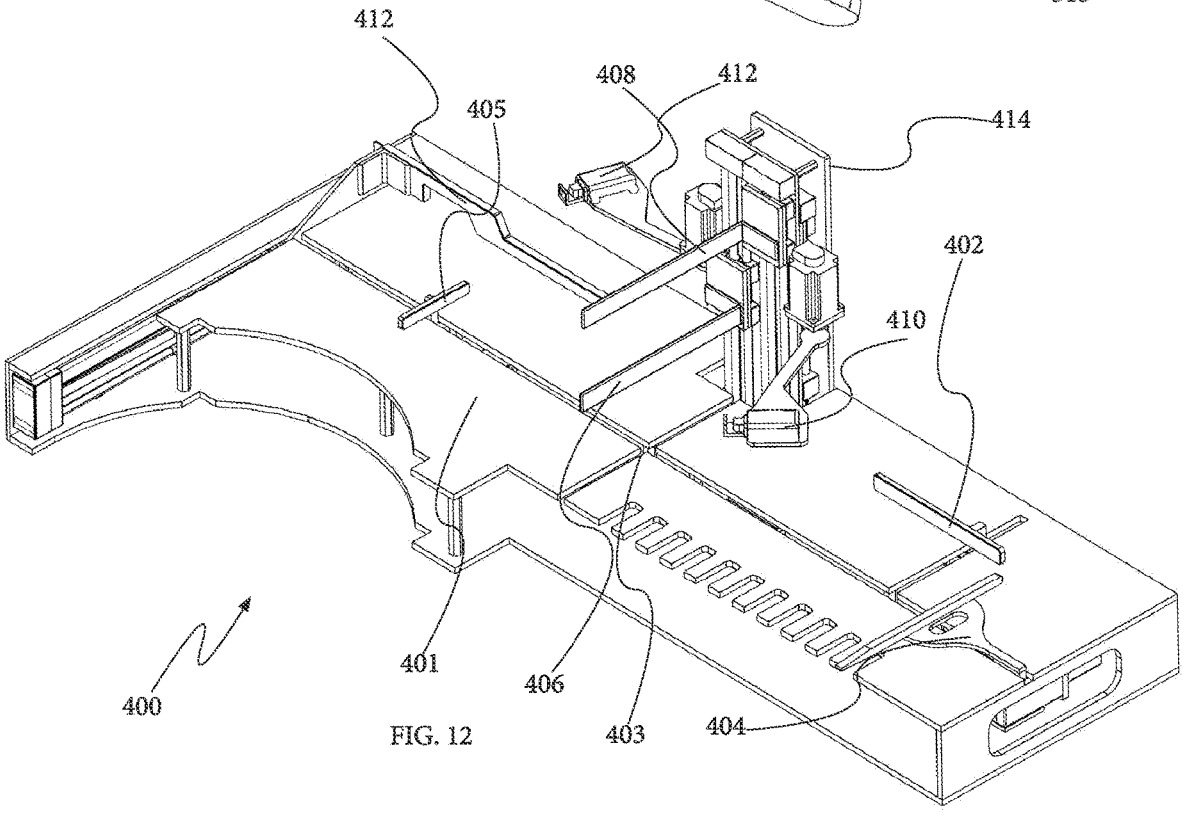
FIG. 12 shows a taping and dispensing module according to one embodiment of the disclosure.

After the paper flaps are creased by the flap closing arms, the paper will be relatively secure around the box, allowing the box to be moved through the machine more easily, before adhesive needs to be applied. Therefore, another pusher rod 404 may be used to push the unsealed box into its proper position adjacent the adhesive and flap closer. Pusher 404 may also be used to hold the box in place as the wings are closed and sealed. As shown in FIG. 12, pusher 404 is configured and arranged such that the open paper flaps adjacent the pusher are not disturbed by the pusher 404 as it engages with the object.

A preferred paper flap/wing scaling process is now described. The object is pushed across platform 401 using pushers 404 and 405 such that one edge of the object having an open flap is positioned adjacent open slot 403. At least one adhesive applicator 410, 412 is configured to apply adhesive to the object (or to paper covering the object) at variable and selectable locations. For example, adhesive applicators 410, 412 may be connected to a track assembly 414 to permit programmable movement of the adhesive applicators 410, 412 to a desired location corresponding to the dimensions of the object.

Adhesive, such as that from a glue stamp or tape stamp 410, 412, may be applied to the object at a selected height, for sealing the bottom wing on one side of the object. A moveable bottom closing arm 406, initially positioned in a retracted position below platform 401, is moved upwards adjacent to the object and is used to fold a bottom flap up against the box and seal the flap to the object using the applied adhesive. An opposing top flap on the same side of the object may then be closed, again using an application of adhesive, in a similar fashion, this time utilizing closer arm 408, which begins above the object and moves in a downwards motion adjacent the object to fold and seal the remaining open flap on that side of the object. The state of the nearly wrapped object is now as generally illustrated in FIG. 23. In some embodiments, adhesive may only be applied after a first flap is folded, to an area of the paper where the flaps are configured to overlap. In this case, no adhesive need come into contact with the object at all. Also in this case, the bottom closing arm 406 may be used to help hold the bottom flap in place before it is sealed closed.

Pushers 404 and 405 now work to realign the final remaining unwrapped side of the box with open slot 403, wherein the above-described process is substantially repeated again, allowing the final flaps/wings to be closed and secured. In the illustrated embodiment, two adhesive stamps are used, one to apply adhesive to each side of the object.

A preferred adhesive applicator may be a double-sided glue stamp. Such adhesive choices permit the automated machine 10 to stamp and move (thus no sliding or rubbing adhesive components are necessary). Echo dots are another adhesive option, but these do require a "push and rub" configuration to be added.

Figure 13:
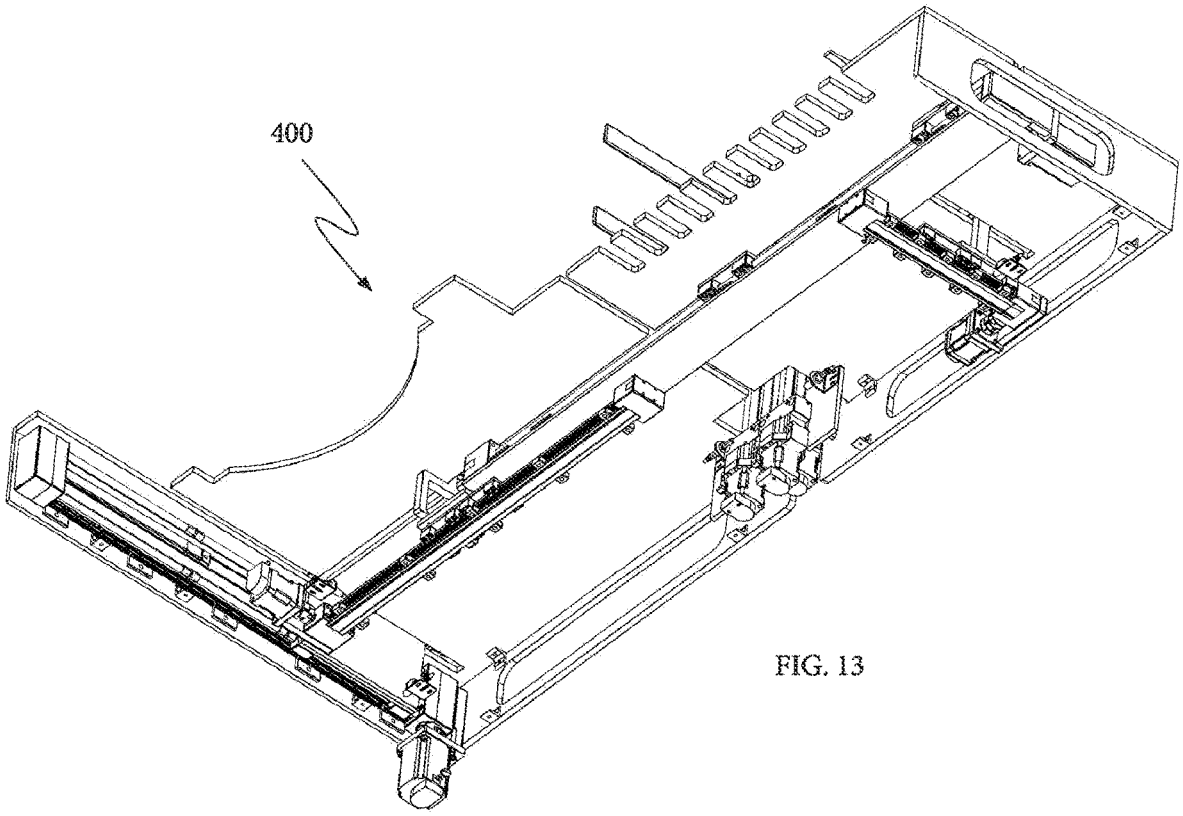
FIG. 13 shows an alternative perspective view of the taping and dispensing module of FIG. 12.

Finally, the fully wrapped box is pushed towards the exit of the machine using pushers 404, 405 and 412, back onto the same platform 30 on which the unwrapped object was initially placed, and the platform is configured to return to its starting position. FIG. 13 illustrates an alternative view of adhesive module 400, showing a plurality of pusher tracks, motors, and additional machine 10 components. Thus, an unwrapped cuboid object having an arbitrary size is placed on a platform of a wrapping machine, then the wrapping machine fully and autonomously wraps the object in paper, and the machine returns the fully wrapped object to its starting position on the platform.

A microcontroller and PCBs may be used to help perform service/maintenance on the machine. E.g., take inventory of how much paper and tape is left, whether the garbage needs to be emptied, and preform technical calibrations (e.g. tensioning). These things may be monitored and/or performed remotely via a network.

A certain thicknesses of paper may be recommended or required for proper use, as the machine may not perform optimally is the paper is too thin.

Advertisements may be provided to a user on the device screen, for example, as the machine may provide dedicated time of 30 s of attention (or other time approximately equal to the amount of time it takes to wrap the box or boxes). The wrapping machine may be placed close to a point of sale in a physical store. Advertisement can be changed remotely on the fly. Premium ad time slots might be more expensive to purchase. Advertising may be targeted based on the specific gift that goes into the machine.

Figure 24:
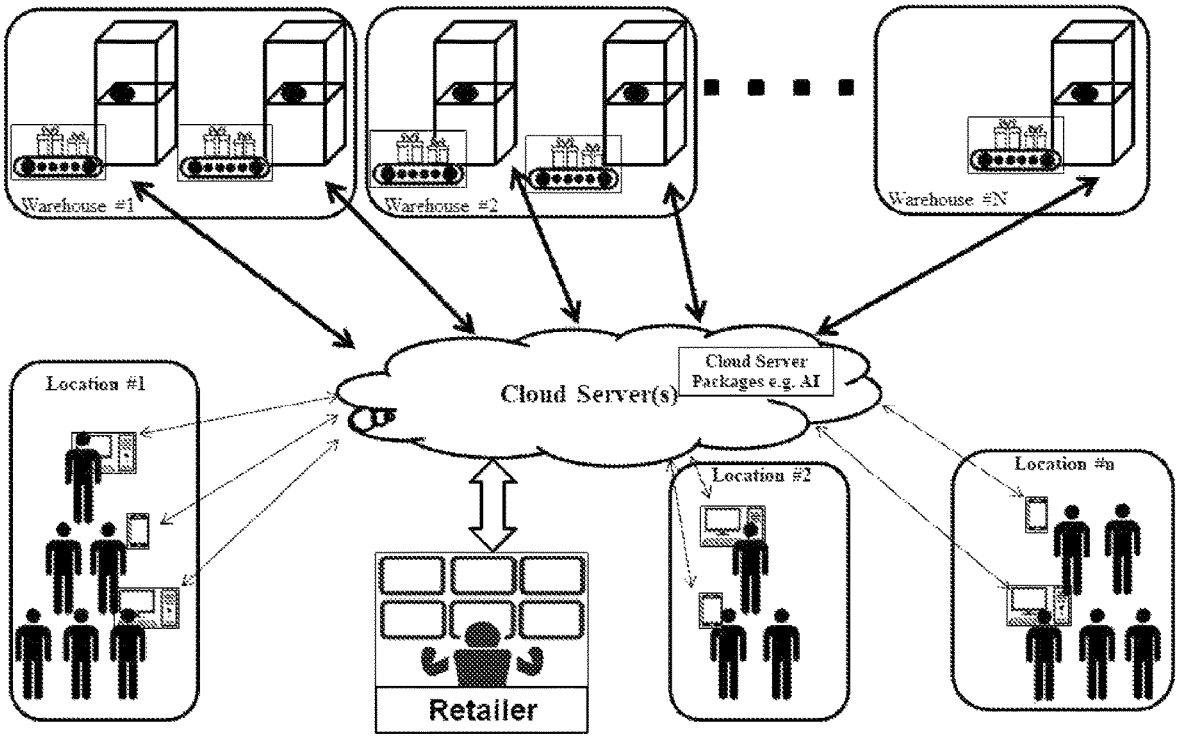
FIG. 24 shows a block diagram illustrating a deployment of wrapping machines according to one embodiment of the disclosure.

The automated wrapping machine may further be configured to run in a warehouse in conjunction with traditional or existing assembly lines. A conveyor belt may run right into the machine (in place of having a platform that lowers and raises the box). Similarly, a fully wrapped box may be configured to exit an area of the machine opposite the area that the box enters in. One embodiment illustrating a deployment of machines 10 is shown in the block diagram in FIG. 24.

The machine may be configured to utilized double-sided wrapping paper. The machine may further be configured to utilize n-number of wrapping paper rolls.

Figure 14:
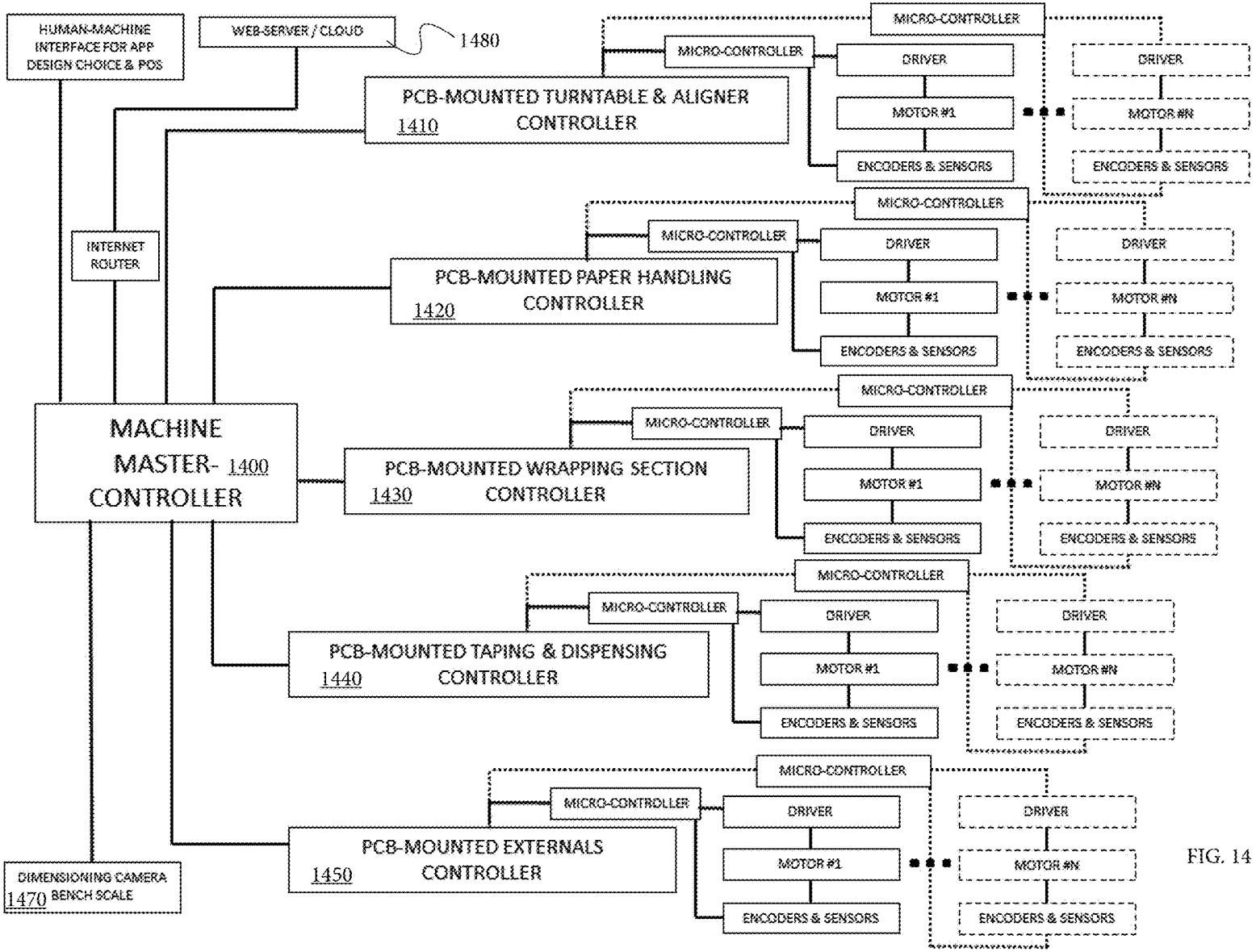
FIG. 14 shows a block diagram of the primary controllers and interfaces according to one embodiment of the autonomous gift wrapping machine.
Figure 15:
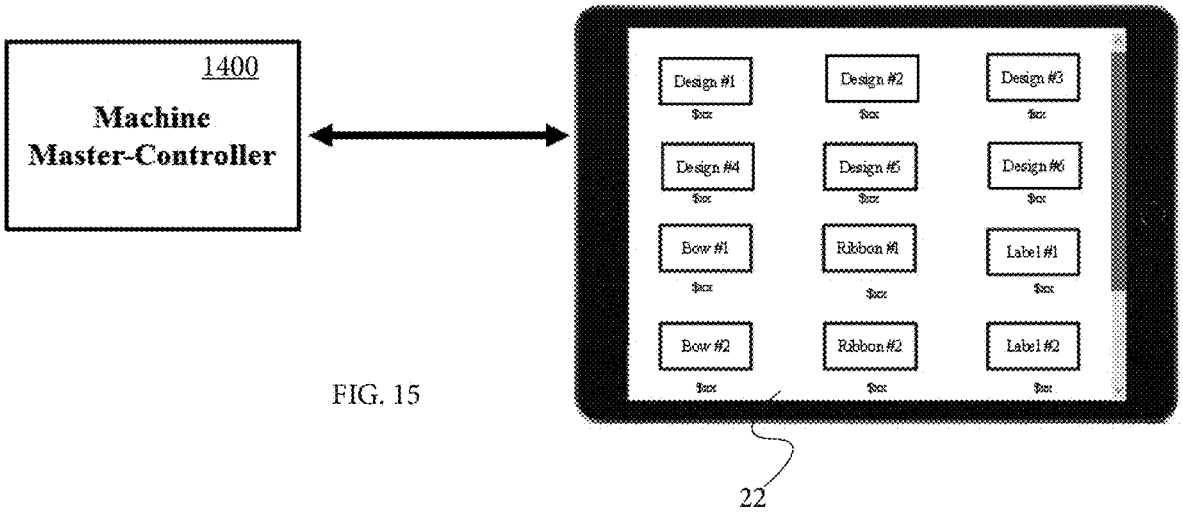
FIG. 15 shows a tablet interface according to one embodiment of the autonomous gift wrapping machine.

FIGS. 14-17 illustrate and describe further details of the underlying control system and logic flow of a preferred embodiment of the disclosure. As shown in FIG. 14, machine 10 may be configured with a master controller, which may be configured to communicate with controllers of each of the main machine 10 sub-assemblies, such as a platform turntable & aligner controller 1410, a paper handing controller 1420, a wrapping station controller 1430, an adhesive & dispensing controller 1440, and a peripheral controller 1450. Master controller 1400 may be further configured to communicate a user interface 1460, device accessories such as a dimensioning camera or label printer 1470, and over a network 1480. Each device 10 subassembly may further include any number of micro-controllers, drivers, motors, encoders and/or sensors as needed to implement the design choices contemplated herein. The user interface may be provided via a computer or mobile application, such as the table-based interface illustrated in FIG. 15.

Figure 16:
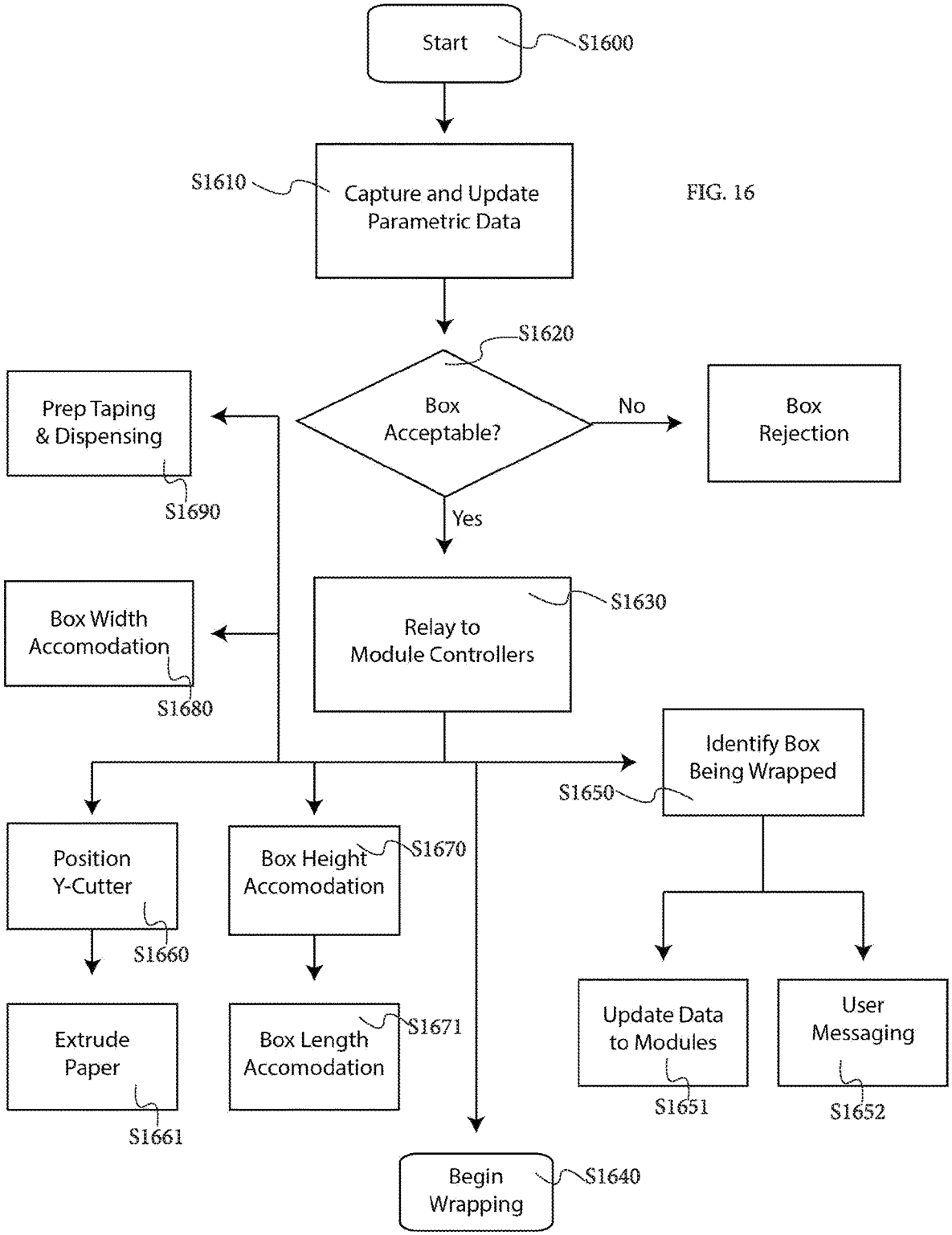
FIG. 16 is a flow chart of the control logic according to one embodiment of the disclosure.
Figure 17:
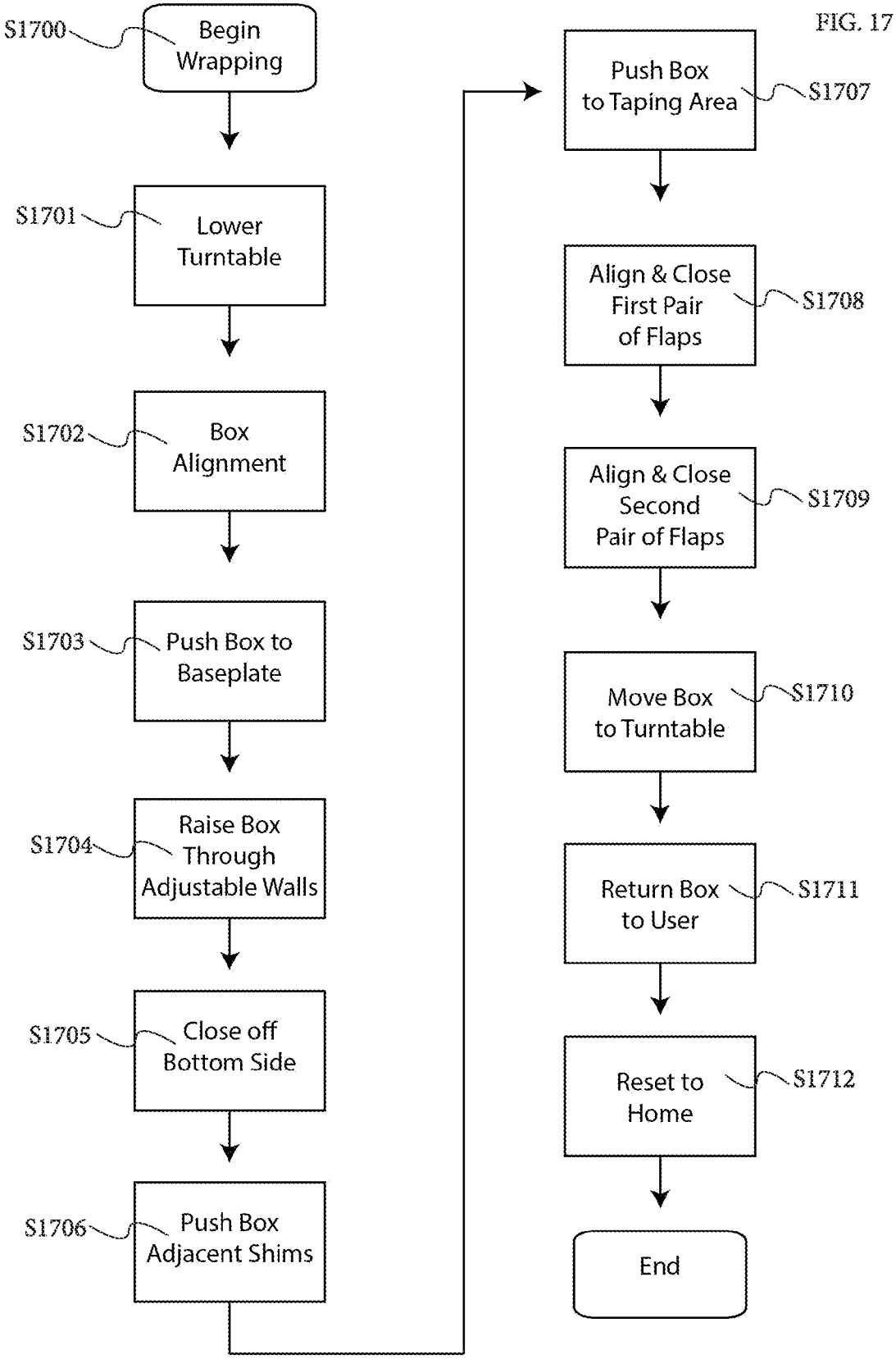
FIG. 17 is another flow chart of the control logic according to one embodiment of the disclosure.

Now turning to FIGS. 16 and 17, exemplary machine 10 logic flow will be further described. Referring to FIG. 16, starting with step S1600, an arbitrary sized box to be gift-wrapped is placed in any orientation on the machine 10 platform 30. The platform 30 may comprise a turntable, and the machine 10 may comprise more than one platform 30. Moving to step S1610, in one embodiment, the machine 10 platform 30 has been calibrated such that an overhead dimensioning camera is used to obtain the length, width and height of the box, as well as its linear and angular placement on the platform 30. A bench-scale integrated with the platform 30 and connected to a controller provides the weight of the box. In a retail setting, a consumer may also choose a gift-wrapping paper design, which could require a selection of either of the facets (top or bottom) of a double-sided gift-wrapping paper roll.

At step S1620, acceptance or non-acceptance of the box is determined. Upon acceptance, (e.g., based on box dimensions and shape—or otherwise, e.g. payment received), information and/or signals are sent to the machine 10 sub-assemblies at step S1630. For instance, box shape, length (L), width (W) & height (H); weight; position and placement angle of box on platform, paper-design choice; calculation and transmittal of desired wrapping paper size (2D) as (L+H+overlap)×(2 (W+H)+overlap). As described herein, if the use of one or more shutters is required to reduce paper handling platform spacing to support wrapping paper over the platform opening, activate them on the top or bottom level. At step S1640 the platform is actuated and the box is lowered into machine 10 to begin the wrapping process.

The machine 10 may be configured to perform several tasks simultaneously with starting the wrapping process. At step S1650 a barcode reader and/or camera system connected to the machine 10 processor may be used to identify or help identify the nature or identity of the object to be wrapped, such as via cross-referencing with an existing database (locally or via a network) or with the assistance of artificial intelligence. Upon such object identity recognition, at step S1651 a display panel or other user interface can then play targeted or generic audio or video advertisement(s) for the length of the wrapping cycle. Such object identity information may also be used to relay additional parameters, such as official box size information, to machine 10 sub-assemblies, in step S1652.

At step S1660, a Y-cutter blade is positioned to a correct placement according to a desired calculated by (L+H+desired overlap). At step S1661, the paper is extruded through the nip-rolls on to the top or bottom paper platform (depending upon which face was selected by user) for a total paper size of 2 (W+H)+desired overlap. The paper is cut using the X-cutter after extrusion. Extruded paper slit by the Y-cutter as it is extruded.

Excess paper may be guided directly to the lower platform and fed to a shredder in the waste module, while the useful paper lies awaiting the box on the platform. An optical sensor could also be used to track paper position. The wheels on the bottom platform are energized and continue to roll the discarded portion of gift-wrapping paper completely across and into the paper shredder where it is shredded to a desired specification and purpose (such as for confetti or for gift-basket filler), at which point the bottom platform is again fully available.

If the bottom facet of double-sided gift-wrapping paper is to be utilized for gift-wrapping, the double-sided gift-wrapping paper is pushed all the way across the top platform and turned around using a guide on to a lower platform at which point the lower platform wheels are energized and engaged as they push the double-sided gift-wrapping paper to the correct position, with the bottom facet of the double-sided gift-wrapping paper now facing up. An optical sensor array is used to accurately track the leading edge of the gift-wrapping paper into its correct position as it awaits the box to be gift-wrapped.

To respond appropriately for wrapping boxes of arbitrary heights, the machine makes the necessary internal accommodations to make height adjustments. With this mode of gift-wrapping, creating the top flap for varying heights is a key objective. This is accomplished with the use of multiple thin but rigid 'shim sets' and their respective 'shim selectors' with wedges as shown and described above. There may be four such shim sets, each corresponding to the four vertical edges of the box. The number of shims to be deployed for any particular box depends upon the height of the box and the known height of the shims.

The number of shims to be deployed is accomplished by a 'shim selector' wedge mechanism as described herein. The shim selector is energized and actuated vertically to the correct height such that a wedge awaits the shim sets to arrive, at which time the wedge is inserted between two shims creating an opening whereby the gift-wrapping paper can be inserted, pinched and flapped. The four sets of shims are each moved to their respective shim selectors whereby all four wedges insert between desired shims (e.g., based on box height), the shim selectors are then actuated and lifted, raising all of the shims that are above the selector, then the shim selector is moved further inward and lowered, thereby lodging the selector wedge into the shim immediately below using the wedge pins, and creates the necessary opening that shall be required for top flapping. The shims located above the wedge are redundant and do not serve any further purpose for a box of this particular height; the shims below the wedge serve as a wall that provides the shearing force necessary when the box is pushed through, to fold the paper over the vertical edges of the box, as well as to create the top and bottom flaps on the two uncovered sides (width×height face). Note that the bottom flapping is accomplished simply by the non-adjusting space between the platform and the bottom-most 'shim' in the shim set (see FIGS. 7-8). The configuration described above allows gift-wrapping to be accomplished for boxes with arbitrary heights.

At step S1670, the machine 10 prepares components based on a measured height of the box. A desired number of shims needed for gift-wrapping based on the box height is calculated, all four shim-selector wedges and positioned to the correct height, and the shim stacks are positioned to engage with the shim selection assembly. The four shim stacks are moved to respective shim-selectors; shim-selector wedges insert between the correct shims and lift away the uppermost (unrequired) shims. At step S1671, each of two corresponding pairs of shim sets then move their respective positions, creating spacing to accommodate for required box length (L). The multi-flap pusher 320 is opened or closed as needed (with increasing widths provided via section 81<section 80<section 82 folded) to create the desired dimension (corresponding to the following combination options: section 80, section 80+section 81, section 80+section 82, and section 80+section 81+section 82) for pushing box on the length-side during and after the flap creation process.

At step 1680, the machine adjustable walls within the primary wrapping chamber are spaced in accordance with the box's width (W).

At step S1690, at least one supporting rail in the adhesive application section is moved to its correct position, to ensure the box is secured in properly aligned position when it is received after the flaps are created. The front and back adhesive mounts are energized and actuated to the required height for eventual adhesive application on the paper as one of the last steps of the wrapping process.

Turning to FIG. 17, an exemplary method of fully and autonomously wrapping a box is described. At the beginning of this process at step S1700, an object such as a cuboid box has been placed onto the platform of the machine, the box has been accepted for wrapping, and the platform has started lowering into the machine at step S1701.

Once the box has started to be lowered, at step S1702 the box is rotated using the platform turntable to generally align the box with the paper rolls, and then mechanical box-aligner arms are energized and initiated to move symmetrically inward and push the box towards the center of the platform while keeping it parallel to the gift-wrapping paper rolls. The box aligners could be moved and stopped when they detect adequate resistance from the box, or sufficiently to perfectly accommodate the width dimension of the box.

At step S1703 a box pusher is then actuated to push the box on to a double-stage baseplate and into such position as to allow for sufficient gift-wrapping paper to later create flaps on the front and back facing sides of the box (with the flaps themselves being large enough to create a desired overlap when they close).

At step S1704, the box and paper symmetrically pass through the paper platform openings, as the box is pushed upward through the paper platform openings (in the middle of the cut paper), via a scissor mechanism built into the baseplate on which the box had been positioned. In other words, the baseplate is actuated in the first stage to push the box upward (vertically) through the opening where the gift-wrapping paper sheet is resting (horizontally) such that the box rises with the gift-wrapping paper folding over its sides and covering the top of the box.

The second-stage actuation of the baseplate further pushes the box into and through the adjustable walls. The adjustable walls provide a shearing force with the box's upward motion such that the wrap paper neatly wraps the top (length×width face) and the two sides (length×height faces) as it enters into the primary wrapping chamber of the machine. Adjustable top and side stoppers are energized to secure the box in position for the ensuing gift-wrapping steps. At this stage we have an inverted-U shape wrapped around the box.

After the platform is freed of the box, the box aligners are retracted, and the platform is re-energized and raised up to be level with the adhesive application section, where the fully wrapped box will eventually be received back on to the platform for dispensing.

Now referring to step S1705, saw-tooth comb plates then move in tandem so as to wipe and cover the bottom face of the box with an overlap. A saw-tooth comb from the right actuates to the left lifting and draping the bottom half (right) face of the box. Simultaneously, the box is pushed by an energized and actuated by the multi-flap pusher, such that the bottom (left) half of the gift-wrapping paper wipes the bottom face and creating a slight overlap with the right half of the face covered with the gift-wrapping paper. The right side is slightly faster and finishes first, then the box is pushed to finish the bottom overlap—and in S1706 the flaps are created nearly simultaneously with this process.

The multi-flap pusher continues to push further (right to left, as shown with reference to FIGS. 7 and 8) such that wrapping paper is folded inward onto the box over the four vertical edges, and this pushing of the box also squeezes the wrapping paper into the top and bottom shim openings, creating the top and bottom flaps, respectively, on the two uncovered sides (width×height) of the box (see FIGS. 21-22). The box is continued to be pushed by the multi-flap pusher across the entire wrapping section with the four flaps getting continually pinched to provide flap memory.

Moving on to step S1707, the box is pushed into the adhesive application section until it is secured by against a receiving rail (along the length of the box). In step S1708, a pusher is energized to push the box from its flapped side such that the opposite-face flaps are positioned for closing. A rectangular wiper is energized to push the bottom flap up into place as it folds over the bottom edge of the box. A glue mount is then energized and rotated to apply a glue dot at or near the top edge of the bottom flap. A second rectangular wiper is energized and pushed down to close the top flap over the glue dot and on to the lower flap with slight overlap. In this way, adhesive is placed on the paper only, not directly on the box itself.

At step S1709, the pusher is re-energized and actuated to move the box further forward into a position such that the process above of closing the remaining open flaps can be repeated using the same top and bottom rectangular wipers. In this case, the back glue mount dispenses the glue dot for the flaps to close.

At step S1710, the pusher is re-energized and again actuated to move the box further forward whereby the pusher is now energized and actuated to push the box onto the platform that is awaiting the fully gift-wrapped box. Upon receiving the neatly and fully gift-wrapped box, the platform is energized and actuated to move upward to its original position for dispensing in step S1711.

In step 1712, upon the completion of the gift-wrapping cycle, any advertising on the display panel or other user interface could be stopped. All machine level data including automation data (including sensor data) from this cycle can be transmitted from the various memory banks within the machine to the master controller, which is then able to transmit the relevant information to a computer network for machine servicing and monitoring purposes or further operations (e.g. utilizing IoT protocols).

Real Time Object Recognition Based Advertising

In a preferred embodiment of the disclosed automatic wrapping machine, the machine may be presented to a user in a retail setting. For instance, a kiosk may be setup in a retail store or mall, allowing a user to conveniently wrap a box containing a retail item that was just purchased from the same location. The automated wrapping machine may be configured with a screen and/or speakers that can be used to provide audio and/or video to users or potential users. For example, the automated wrapping machine may be configured to play advertisements through the screen or speakers, including at a point of sale location in a retail setting. Advertisements could be presented to all potential users while the automated wrapping machine is not actively being used to wrap a gift, or advertisements could be presented to users of the wrapping machine while they are waiting for their gift to be wrapped.

In certain instances, the advertisements presented to a user may be targeted advertisements. For example, a retail store may provide video advertisements to a user, via the screen on the automated wrapping machine, using stock or custom .mp4 video files. Such advertisements may be related to an active promotion that the store is offering, and possibly related to the purchase of a particular item at the store. The store may have real time control over the advertisements that are presented to potential users.

It is anticipated that targeted advertisements on the automated wrapping machine may be specifically related to the object that is to be wrapped. For instance, the wrapping machine camera may be further configured to recognize the specific object to be wrapped, and then present a user with targeted advertising based on such object. By way of example, the automated wrapping machine camera may be configured to detect that the object to be wrapped is a box containing a new pair of sneakers. Such image recognition may be achieved using a combination of image analysis and object libraries using methods generally known in the art.

Based on this recognition, the automated wrapping machine may be configured to present the user with advertising related to the sneakers, such as a waterproof and stain repellant. In some embodiments, a user may be presented with a specific promotion that is related to the detected object. Continuing with the prior example, a user may be presented with a coupon for 20% off stain repellant based on the detection of a box of sneakers to be wrapped. Information related to promotions may be tracked in order to provide conversion data related to a particular advertisement campaign. For instance, if a coupon is presented to a user, the automated wrapping machine may be configured to track if and when such coupon is redeemed. One of ordinary skill will recognize that any number of alternative targeting criteria may be used.

In alternative embodiments, the automated wrapping machine may be configured with a barcode scanner that can be used to detect the object to be wrapped. For example, a barcode scanner may be integrated within the platform module of the automated wrapping machine, so that any barcode located on the object to be wrapped is detected as soon as a user places the box onto the machine.

Once the object to be wrapped is known with specificity, such as via a barcode scan, not only can this information be used to target specific advertising to a user, but other benefits to having such information are anticipated. For instance, an object library may contain information related to the exact dimensions of the box to be wrapped. This information could be used in lieu of, or to further support, box dimensions that are otherwise gathered by the automated wrapping machine, as described above. Having the exact box dimensions may be used to reduce or eliminate measurement error buffers with respect to calculating wrapping paper size, which may be necessary based on, e.g., the measurement resolution of a software program that measures an object to be wrapped based on an image taken from a camera. In other instances, the automated wrapping machine may be configured to present information to a user via the machine interface without any requirement that an item also be wrapped. For example, a user may be able to use the automated wrapping machine interface to scan an object and be presented with information about the object on a screen, such as pricing, specifications, reviews, competitor comparisons, etc. Such information may be presented to a user in combination with a targeted advertisement related to the object.

In some embodiments, it is anticipated that the automated wrapping machine may gather information about a specific user of the machine. For instance, a user may scan a retail store loyalty card, or log into a store online account. In this case, the automated wrapping machine may be configured to use any information gathered about the object to be wrapped in conjunction with information that is known about the particular user at that time to, for example, further target specific advertising to the user.

In further embodiments of the disclosure, the automated wrapping machine may be configured to offer real-time bidding of advertisements, based on the recognized object and/or specific user. The automated wrapping machine may be configured with software that displays an advertisement of a particular company, based on the highest current bid for that advertisement opportunity. For example, the system may include a bid opportunity related to a user scanning is a specific object, such as a new smartphone. Each time a new smartphone is detected by the automated wrapping machine, an advertisement corresponding to the highest bid for that selection mechanism may be presented. For instance, a plurality of providers of smartphone protective cases may be permitted to bid on an advertisement slot to play an advertisement for any instance that a particular model of smartphone is detected by the automated wrapping machine.

It should be understood that, in various embodiments of the present disclosure, any sequence numbers of the above processes do not mean the order of execution, and the order of execution of each process should be determined by its function and internal logic, and should not be taken to constitute any limitation to the implementation process of embodiments of the present disclosure.

Those of ordinary skill in the art will appreciate that the components and algorithm steps of the various examples described in connection with the embodiments disclosed herein can be implemented in electronic hardware or a combination of computer software and electronic hardware. Whether these functions are performed in hardware or software depends on the specific application and design constraints of the technical solution. A person skilled in the art can use different methods for implementing the described functions for each particular application, but such implementation should not be considered to go beyond the scope of the present disclosure.

A person skilled in the art can clearly understand that for the convenience and brevity of the description, the specific working process of the system, the device and the components described above can refer to the corresponding process in the foregoing method embodiment, and details are not described herein again.

In the several embodiments provided by the present disclosure, it should be understood that the disclosed systems, apparatuses, and methods may be implemented in other manners. For example, the apparatus embodiments described above are merely illustrative. The division of the components described is only a logical function division. In actual implementation, there may be another division manner. For example, a plurality of components may be combined or integrated into another system, or some features can be ignored or not executed. In addition, the coupling or direct coupling or communication connections shown or discussed may be an indirect coupling or communication connection through some interfaces, apparatuses or units, which may be electrical, mechanical or otherwise.

The components described as separate components may or may not be physically separated, and the components displayed as units may or may not be physical components. That is, they may be located in one place, or may be distributed to multiple networked components. Some or all of the components may be selected according to actual needs to achieve the purpose of the technical solution of the embodiment.

In addition, each functional component in each embodiment of the present disclosure may be integrated into one processing module, or each unit may exist physically separately, or two or more components may be integrated into one unit.

The functions described herein may be stored in a computer readable storage medium if implemented in the form of a software functional unit and sold or used as a standalone product. Based on such understanding, the technical solution of the present disclosure which is essential or a part contributes to the prior art, or a part of the technical solution, may be embodied in the form of a software product, which is stored in a storage medium, including instructions to cause a computer device (which may be a personal computer, server, or network device, etc.) to perform all or part of the steps of the methods described in various embodiments of the present disclosure. The foregoing storage medium includes, without limitation: a mobile hard disk, a Read-Only Memory (ROM), a Random Access Memory (RAM), a disk, or an optical disk or other media that can store program codes.

The present disclosure contemplates that many changes and modifications may be made. Therefore, while the presently-preferred form of the system has been shown and described, and several modifications and alternatives discussed, persons skilled in this art will readily appreciate that various additional changes and modifications may be made without departing from the spirit of the invention, as defined and differentiated by the following claims.

What is claimed is:

1. A wrapping machine comprising, wrapping paper;

an object placed on an object platform, wherein the object is a cuboid;

a dimension selection assembly, wherein a particular size of the dimension selection assembly is selected based on at least one dimension of the object; and wherein the wrapping machine wraps the object within the wrapping paper using the selected portion of the dimension selection assembly.

2. The wrapping machine of claim 1, wherein the wrapping paper is fed through the machine from at least one stack of wrapping paper sheets.

3. The wrapping machine of claim 2, wherein the paper sheets are pre-cut to fit a particular range of object dimensions.

4. The wrapping machine of claim 1, wherein the wrapping paper is cut to size based on the at least one measured dimension of the object.

5. The wrapping machine of claim 1, wherein the wrapping paper is fed through the machine from at least one roll of wrapping paper.

6. The wrapping machine of claim 1, wherein the object is rejected prior to wrapping based on at least one object attribute.

7. The wrapping machine of claim 1, further comprising a camera, and wherein the wrapping machine determines the at least one dimension of the object on the platform by analyzing image data from the camera.

8. The wrapping machine of claim 1, further comprising a barcode scanner, and wherein the wrapping machine determines the at least one dimension of the object on the platform by analyzing a database linked to an object barcode.

9. The wrapping machine of claim 1, wherein the at least one dimension of the object is measured by mechanically aligning the object on the platform.

10. The wrapping machine of claim 1, further comprising at least one guide arm that contacts the object, wherein the wrapping machine determines a relative position of the object by analyzing a position of the at least one guide arm.

11. The wrapping machine of claim 1, further comprising at least one guide arm that contacts the object, wherein the wrapping machine determines the at least one dimension of the object by analyzing a position of the at least one guide arm.

12. The wrapping machine of claim 1, wherein the wrapping machine aligns the object with the paper.

13. The wrapping machine of claim 1, wherein the at least one dimension of the object includes the height of the object.

14. The wrapping machine of claim 1, further configured to fold two flaps of paper each across two opposing sides of the object.

15. The wrapping machine of claim 1, wherein a flap of paper is folded over at least one side of the object by the dimension selection assembly applying a shearing force adjacent the paper and across the at least one side of the object.

16. The wrapping machine of claim 1, wherein the dimension selection assembly comprises a plurality of shims.

17. The wrapping machine of claim 16, wherein a number of shims are selected based on the at least one dimension of the object.

18. The wrapping machine of claim 17, wherein the selected shims push over and across the sides of a partially-wrapped object to apply a shearing force over the paper and across the at least one side of the object to create at least one paper flap.

19. The wrapping machine of claim 18, wherein the at least one paper flap is secured around the object.

20. The wrapping machine of claim 1, further configured to identify the object.

21. The wrapping machine of claim 20, wherein targeted advertising or messaging is provided to a user based on the identification of the object and contemporaneous to the object being wrapped.

22. The wrapping machine of claim 1, wherein targeted advertising or messaging is provided to a user based on an identification of the user.

23. The wrapping machine of claim 1, wherein the wrapping machine is integrated into a warehouse fulfillment or conveyance system.

24. A method of wrapping a cuboid object comprising, placing the cuboid object on a platform of a wrapping machine, wherein the wrapping machine obtains at least one dimension of the object;

selecting a particular size of a dimension selection assembly based on the at least one dimension of the object; and wherein the wrapping machine wraps the object within wrapping paper using the selected portion of the dimension selection assembly.

25. A method of wrapping a cuboid object comprising, moving the object into or onto a wrapping machine;

wherein the wrapping machine obtains at least one dimension of the object;

selecting a particular size of a dimension selection assembly based on the at least one dimension of the object; and wherein the wrapping machine fully wraps the object in paper using the selected portion of the dimension selection assembly.

26. The method of claim 25, wherein the wrapping machine first wraps the paper around four sides of the cuboid object, and then folds flaps on two remaining open sides of the object using the selected portion of the dimension selection assembly.

27. The method of claim 26, wherein the object is fully wrapped by folding down and securing the flaps across the open sides of the object.

28. A method of wrapping a cuboid object having an arbitrary size comprising, providing the object to a wrapping machine;

wherein the wrapping machine obtains at least one dimension of the object;

wherein the wrapping machine selects a particular size of a dimension selection assembly based on the at least one dimension of the object; and wherein the wrapping machine fully and autonomously wraps the object within paper using the selected portion of the dimension selection assembly.

* * * * *